US008161573B1

(12) United States Patent
Burns-Cox

(10) Patent No.: US 8,161,573 B1
(45) Date of Patent: Apr. 24, 2012

(54) GARMENTS WITH NONTRADITIONAL ACCESS FOR IMPAIRED INDIVIDUALS

(76) Inventor: Edna Darleen Burns-Cox, Sellersburg, IN (US)

( * ) Notice: Subject to any disclaimer, the term of this patent is extended or adjusted under 35 U.S.C. 154(b) by 1148 days.

(21) Appl. No.: 11/604,046

(22) Filed: Nov. 22, 2006

(51) Int. Cl.
*A41D 13/00* (2006.01)
*A41D 15/00* (2006.01)
*A41D 1/06* (2006.01)
*A41D 13/02* (2006.01)

(52) U.S. Cl. ..... 2/69; 2/227; 2/70; 2/79

(58) Field of Classification Search ..... 2/69, 227, 2/69.5, 70, 79
See application file for complete search history.

(56) References Cited

U.S. PATENT DOCUMENTS 302,901 A * 8/1884 Fenne ..... 2/114
506,502 A 10/1893 Lonergan
1,966,060 A 7/1934 Cohen
2,565,739 A 8/1951 Pointen
2,580,774 A * 1/1952 Helbig ..... 2/212
2,613,363 A 10/1952 Morgan
3,800,330 A 4/1974 Bowcut
3,859,667 A 1/1975 Roy
4,051,854 A 10/1977 Aaron
4,068,315 A * 1/1978 Rainville ..... 2/114
4,258,440 A 3/1981 McGowan
4,638,509 A 1/1987 Charron
4,644,589 A 2/1987 Pettis
4,651,353 A 3/1987 Walden
4,726,076 A * 2/1988 Douez ..... 2/69
4,754,500 A 7/1988 Brucato et al.
4,914,756 A 4/1990 Caluzac et al.
5,008,962 A 4/1991 Smith et al.
5,049,145 A 9/1991 Flug
5,097,535 A 3/1992 Dye et al.
5,112,326 A 5/1992 Quadrini
5,133,086 A * 7/1992 Truitt et al. ..... 2/114
D336,968 S * 7/1993 Russano ..... D2/720
D362,742 S * 10/1995 Bergman ..... D2/745
5,535,450 A * 7/1996 Melzer ..... 2/69
5,546,126 A 8/1996 Yajima et al.
5,564,123 A 10/1996 Grassick
5,621,917 A 4/1997 Howsden
5,624,428 A 4/1997 Sauer
5,924,133 A 7/1999 Zapiti
6,049,913 A * 4/2000 Harrigan, Jr. ..... 2/227
6,101,634 A * 8/2000 Martinez ..... 2/238
6,338,161 B1 * 1/2002 Ali Muhammad ..... 2/78.1
6,477,716 B2 11/2002 Blaire
6,792,622 B2 * 9/2004 Graves ..... 2/114
7,000,261 B1 * 2/2006 Loffredo ..... 2/400

* cited by examiner

*Primary Examiner* — Gary L Welch
*Assistant Examiner* — Amber Anderson

(57) ABSTRACT

This multiple component invention comprises a shirt, pants and bodysuit, which are readily donned without the necessity of executing normal dressing movements. Although conventional looking, this adjustable clothing combination does not don in the conventional manner, this clothing combination opens fully, allowing the physically challenged individual to readily self-don without assistance. The need for bending one's knees, bending forward or downward, removing and replacing one's shoes, is eliminated. The donning of the shirt does not require the individual to fold their arms or raise them to the shoulders. The very nature of this invention and improvements over prior art, allows the individual who has become dependent on others, to return to a life of self-reliance, independently living on one's own. The attributes of this multiple component invention for the wheelchair bound or bed-ridden individual needing assistance, will aid the caregiver, lessening stress on the patient and the caregiver.

12 Claims, 11 Drawing Sheets

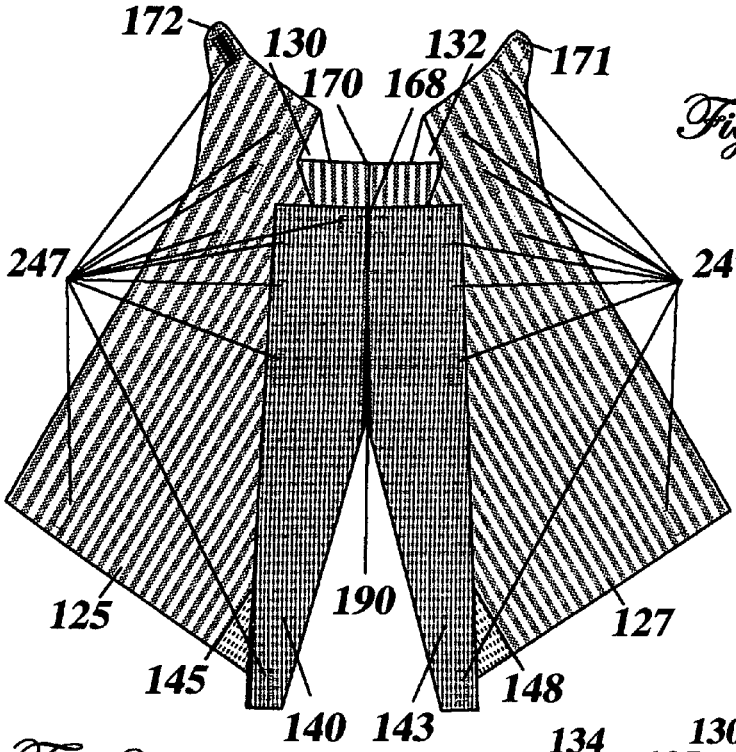
Fig. 7
Fig. 8
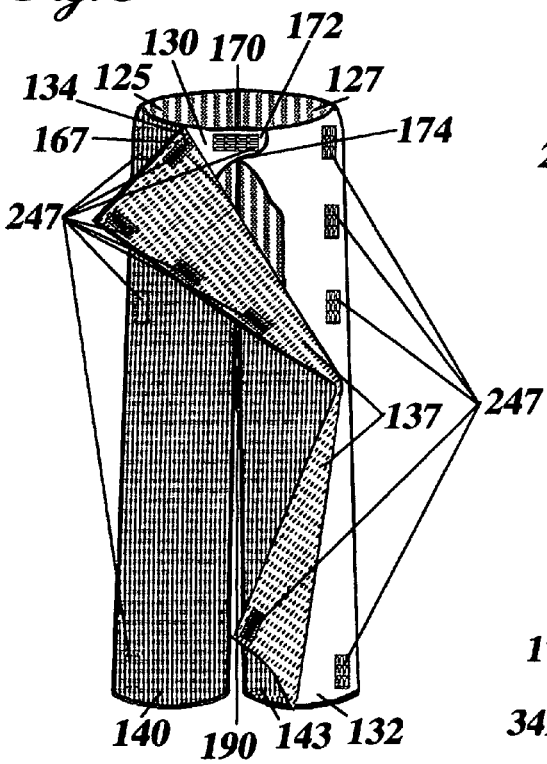
Fig. 9
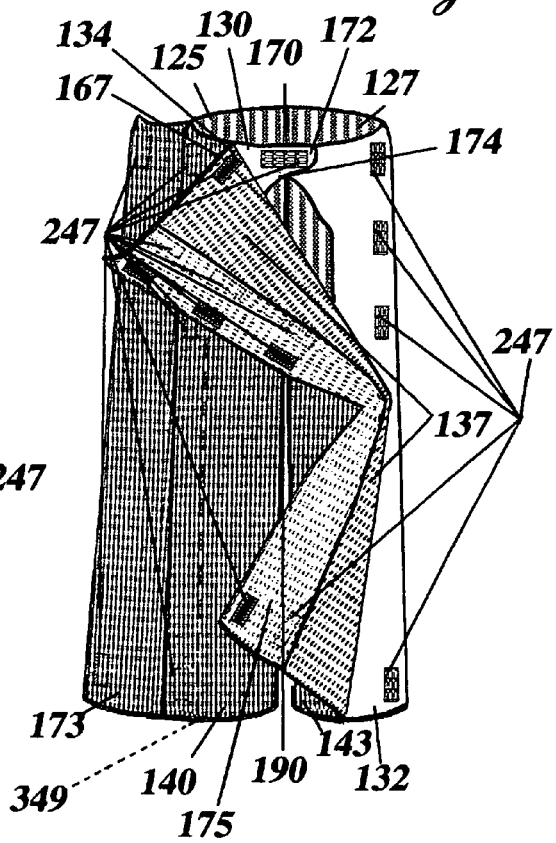

Fig. 10
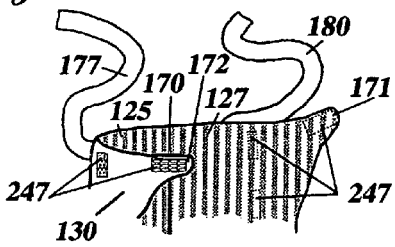
Fig. 11
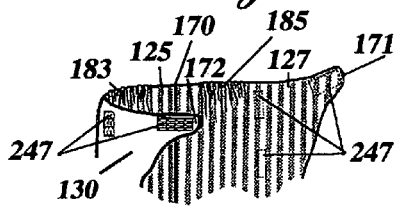
Fig. 12
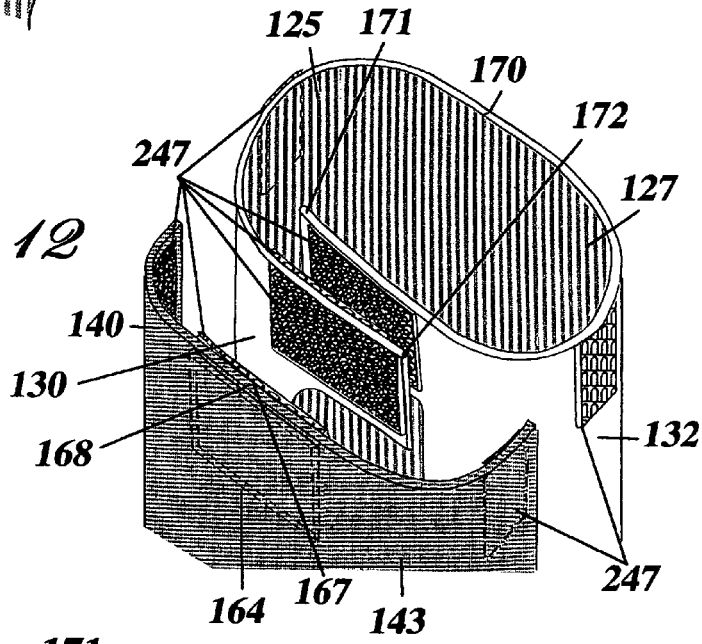
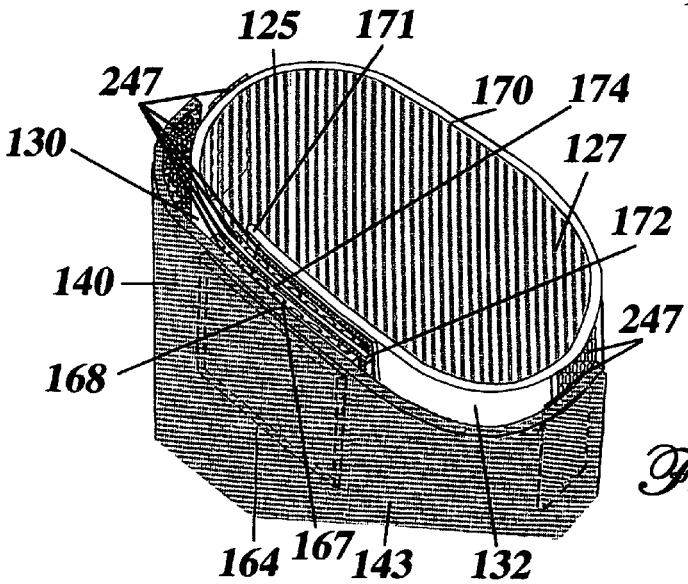
Fig. 13

172
171
167
247
247
130
140
174
343
195
134
137
188
132
146
143

GARMENTS WITH NONTRADITIONAL ACCESS FOR IMPAIRED INDIVIDUALS

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to easy on and off garments for the physically handicapped, infirm, or injured individual.

2. Background of the Invention

I needed hip replacement. Dressing and undressing were excruciatingly painful. It took great effort and was exhausting. Changing my clothing would require removal and donning of my shoes, and was agonizing and detrimental.

I had been informed of the restriction placed on patients with hip replacement to not bend over or bring one's knee toward their face, as this would cause great pain and the threat of dislocation of the hip joint. I would require help to dress, or find clothing to don myself without endangering my recovery. I went in search of clothing. I found nothing, not in stores or the Internet. I needed to invent my own.

In my life challenge, I realized others had various types of problems dressing and undressing, so I set out to invent embodiments for the individual whose normal dressing habits have been lost, curtailed and/or restricted.

Furthermore it has become recognized that the physically challenged, have needs and desires just as do physically able persons, yearning to live as normal a lifestyle as permitted by their disability. In the past, such persons were often restricted to a hospital, other care facility, or their home, where their disability precluded outside activities to any appreciable degree.

Federal requirements for access to public buildings by the physically challenged, and public awareness has encouraged such persons to spend more time in the outside world.

However, many physically handicapped individuals whose normal dressing abilities and dexterity have been lost, curtailed and/or restricted, due to debilitating ailments, dressing themselves in the conventional manner becomes impossible. While to the physically able person normal everyday actions such as reaching one's feet, bending over, or raising one's arms above one's head are taken for granted, however to some handicapped persons the movements are painful and unobtainable. While some physically handicapped individuals are capable of donning standard clothing, the effort required is generally far above that required for the physically able persons. The difficulty of donning a conventional garment when one is handicapped, or wearing a cast, can perhaps best be visualized by attempting to put on a pair of pants or a shirt without folding the leg or arm. It immediately becomes evident that without the folding of the legs for example, the limbs are simply not long enough to permit the insertion of the legs into the pants. As an unfortunate result, some individuals have to forgo wearing trousers or underwear. The psychological effects of this are profound. Still further, if the disabled person is incapable of such, for him or her self, then a caretaker must assist the person in dressing, which also requires a great deal of effort for all parties concerned. There are numerous handicapped persons who face this burdensome difficulty each day, which contributes to their feeling of helplessness and inability to cope with the outside world.

There have been some inroads made in equipping public spaces for the impaired, encouraging such individuals to once again enjoy and share life in the world outside of their home, but many cannot take advantage of these opportunities because it is physically impossible for people suffering from certain disabling conditions to dress themselves.

The act of dressing and undressing might seem a minor procedure to someone not faced with such challenges, but to the many living with these challenges, the outside world is far removed. Many attempts have been made to address the need for clothing for the individual whose normal dressing abilities have been permanently or temporarily lost.

The following prior art patents attest to that need:

Trousers:

U.S. Pat. No. 506,052 to Lonergan, 1893 Oct. 3, disclosed overalls which are openable along the outer seam of each leg, with the seams being closeable by snap fasteners. This arrangement of fasteners would be difficult for the handicapped persons to engage.

U.S. Pat. No. 2,565,739 to Pointen, 1951 Aug. 28, discloses a seat-less, bib-overall having openable out seams in the legs, with the out seams being closeable by slide fasteners. Those who are physically handicapped through stiffness of joints could be caused discomfort in attempting to engage a slide fastener that continues down the entire length of the leg.

U.S. Pat. No. 2,923,009 to Cookman, 1960 Feb. 2, discloses a multiple-opening trouser with plackets from waist to cuff, and snaps, for handicapped persons. Bending from the knee or waist is required to open and close the placket, which is impossible for some impaired individuals, due to pain, stiffness or physicians restrictions. Also there is no room for adjustment in size of the garment.

U.S. Pat. No. 3,800,330 to Bowcut, 1974 Apr. 2, disclosed jeans that are openable along the outer seam of each leg, with the seams being closeable by a slide fastener, and snaps. It becomes necessary to bend from the waist to reach the bottom of the jeans or bring ones knees toward ones face to close the jeans entirely. For the individual whose dexterity has been restricted or lost, due to ailments such as painful arthritis, using their fingers in a normal manner is very difficult, in some cases impossible. Therefore slide fasteners and snaps pose a painful, arduous task for the physically challenged.

U.S. Pat. No. 5,097,535 to Dye, et al. 1992 Mar. 24, also referred to in the shirt prior art section, discloses a garment resembling pajamas in which the legs are easily opened and closed the entire length with releasable fastener means. The openable legs, the entire length of the garment require the alignment of the releasable fasteners, this is very hard for a person to do by themselves, causing the person to bend from their waist to a straight legged position, almost standing on one's head to align the releasable fasteners. As this is a very difficult maneuver, assistance to don this garment would be required.

U.S. Pat. No. 6,477,716 to Blaire, 2002 Nov. 12, discloses an easy opening pants with a zipper positioned along the entire inseam of the leg members. Zippers require that the operator have both strength and dexterity. Although not completely necessary, two hands are usually used when zippering—one hand holds the zipper tab, and the other hand tries to maintain the garment halves close together and parallel to facilitate the zippering. Further, it is quite difficult when only using one hand to engage the zipper teeth into the slide. For the individual suffering from arthritis this would be an arduous task. For the stiff or impaired individual bending to the floor to initially engage the zipper would be physically challenging if not impossible.

U.S. Pat. No. 4,644,589 to Pettis, 1987 Feb. 24, describes self-administrable garments for arthritic persons. The Pettis garment has a vertical split along the frontal midline. For the arthritic individual it would be very cumbersome to align and engage the pressure-actuated fastener along the frontal midline and down the crotch of the garment. Also inserting his or her leg in the leg aperture of the garment requires the knee to be brought towards the face, or the person to bend towards the floor. These actions may cause pain to some handicapped individuals; to others these movements are impossible, thereby requiring a caretaker. Going to the restroom or allowing a physical examination would cause the Pettis garment to hang loose or fall away leaving the individual completely exposed, feeling vulnerable and embarrassed. There is a subsequent reference to the Pettis patent in the shirt prior art section.

U.S. Pat. No. 4,638,509 to Charron, 1987 Jan. 27, describes a protective outer garment for divers. The garment comprises a pair of leg portions each having an openable outer side seam, with clips and snaps. Individuals with disabilities would find it difficult if not impossible to align and fasten the outer side seams. An individual with painful arthritis would be incapable of operating the clips and snaps. This garment would require assistance in donning and removal.

U.S. Pat. No. 4,914,756 to Grassick, 1990 Apr. 10, describes an article of clothing for the handicapped, involving pants in which the closure runs the entire length of the garment requiring the individual to bend forward toward the floor or bring the knees toward the nose to don this garment. Some impaired persons are not able to do this because of their disability, pain or restrictions imposed on them by a doctor.

U.S. Pat. No. 5,924,133 to Zapiti, 1999 Jul. 20, discloses a pair of pants in conjunction with the forthcoming reference to a dress shirt. Zapiti claims a fastening system to help individuals who have difficulty in manipulating a zipper. The closure system of the garment is a series of hook and loop fasteners. The pants are comprised of two leg openings, requiring the individual to don this garment in the conventional manner. The individual must bend to the floor or bring the knee up towards the face to don this garment. Because of pain or other restricted movements of their limbs or appendages, it is difficult, in some cases impossible, for the individual to do this on their own, creating the need for assistance of others.

U.S. Pat. No. 5,008,962 to Smith, et al. 1991 Apr. 23, claims easy to fasten trousers with two selectively openable seams which extend from the upper edge to the hem. The individual must reach to the floor to don this garment, furthermore to align the hook and loop fastener along the entire length of the garment would be tedious and frustrating, persons with dexterity problems would find this an arduous task, difficult to do if not impossible.

In practice, the trousers disclosed in these patents, although functional, require bending to the floor or bringing the knee up toward the face. Some physically handicapped people cannot do this, and require assistance. If the individual does manage on his or her own, he or she may be in a great deal of pain and may cause further injury.

Shirt:

U.S. Pat. No. 6,868,556 to Jenkins, 2005 Mar. 22, claims a conventional looking shirt with hook and loop fasteners, comprised of a pair of shoulder seams, a pair of side seams, and buttons. For individuals suffering from arthritis who have limited manual dexterity, manipulating such fastening devices as buttons can be painfully difficult and sometimes impossible, also the claim of shoulder seams and side seams requires the individual to don the garment in the conventional manner, causing possible pain in the shoulders and joints. To some physically challenged individuals assistance to don this garment would be required, leaving the physically challenged person to feel helpless and a burden.

U.S. Pat. No. 6,216,271 to Chen, 2001 Apr. 17, discloses a garment for a hospital patient. This is a garment to be used in a hospital or doctors office setting only. It does not have the look of conventional clothing. It would require assistance to don.

U.S. Pat. No. 5,924,133 to Zapiti, 1999 Jul. 20, discloses a shirt in conjunction with the previously mentioned pair of pants. The garment fastening system is comprised of hook and loop segments. This garment having permanently closed shoulders seams and side seams, requires the individual to don the garment in the conventional manner, this may cause physically challenged individuals suffering from ailments such as arthritic conditions or injury to experience pain in the shoulders, back or neck, trying to don this garment.

U.S. Pat. No. 5,621,917 to Howsden, 1997 Apr. 22, discloses an infant care garment having closures located along the top or shoulder portions of the garment and down the front.

U.S. Pat. No. 5,564,126 to Chou, 1996 Oct. 15, discloses a partially or fully open type upper garment for patients. This garment requires donning in the conventional manner. The physically challenged person would require assistance in donning and removal of this garment. The zipper may hinder the individual with dexterity limitations and/or arthritis from being self-sufficient.

U.S. Pat. No. 5,564,123 to Grassick, 1996 Oct. 15, discloses a single piece upper garment having a conventional appearance with the ease of donning and removal by the physically challenged person and/or assistant or caretaker, with the requirement of wrapping the garment about the physically challenged person and temporarily fastening seams. To temporarily fasten and refasten the reusable fastening means, with the suggestion of placing the garment on the persons back, or that the person may lie on the back portion of the garment then close the shoulders is tedious and challenging. These actions would be very frustrating for a physically challenged individual, causing the need of assistance. This garment would not allow the individual to be self sufficient and live independently.

U.S. Pat. No. 4,698,848 to Buckley, 1987 Oct. 13, describes a blouse for cardiac patients. A front rather than side seam closure is provided. With conventional arm openings, requiring the wearer to slip his or her arms through the openings can be formidable and painful for the physically challenged, in some cases requiring the assistance of others.

U.S. Pat. No. 5,097,535 to Dye, et al. 1992 Mar. 24, previously mentioned in the trouser section of prior art, discloses a garment resembling pajamas in which the sleeves are opened and/or closed the entire length with releasable fastener means. Each sleeve is divided by an openable seam which extends for the entire length of the sleeve from the collar portion of the shirt, surrounding a wearer's neck, to the cuff portion located adjacent to the wearer's hand. For a physically challenged person trying to align the entire hook and loop seam while on the body by one's self would pose a very difficult maneuver. Moreover aligning a long length of hook and loop is tedious for an able-bodied or handicapped individual. Furthermore if this invention were closed off the body, then donned, it would be the same as donning a conventional garment. Trying to align a long line of releasable fasteners is tricky, thereby causing the need for assistance.

U.S. Pat. No. 4,718,124 to Sawicki, 1988 Jan. 12, discloses a gown that meets the specialized needs of patients. An object of the Sawicki invention is to provide a patient gown with fastening means, which enables a disabled or handicapped person to secure same without the need of assistance. Since the opening to don the garment is on the back of the gown, and that the garment has slits extending from the neck, and along the arms, with hook and loop type mating surfaces, a person with limited mobility in their arms and shoulders would be physically unable to secure the mating surfaces, thus requiring a disabled person the needed aid of a second party.

U.S. Pat. No. 4,570,268 to Freeman, 1986 Feb. 18, discloses a patient garment with openable shoulder seams, with hook and loop type fasteners. When the hook and loop fastener is released at the shoulder, the back of the garment falls down the back of the individual making it difficult if not impossible for the physically challenged to refasten the fastener. This action requiring great effort of the physically challenged person may cause unnecessary pain, exhausting them, showing the individual to be unable to function on their own. The patient will, after closing the arms at the sleeve fasteners, have to don the garment in the conventional manner. This garment requires assistance in donning.

U.S. Pat. No. 4,258,440 to McGowan, 1981 Mar. 31, describes clothes for the physically handicapped comprising both lower and upper garments. The panels are secured by means of hook and loop fastening material. It is noted that the shoulder portions of the upper garment are permanently closed, thus providing a permanently closed neck opening and requiring the garment to be pulled over the head of the wearer. For some physically challenged individuals it is impossible to raise their arms above their head and finesse a garment down their torso.

U.S. Pat. No. 4,754,500 to Brucato, et al. 1988 Jul. 5, describes special garments for the disabled and infirmed. The garments are provided with back (rather than side) closures and the sleeves are permanently closed tubular configurations, rendering the Brucato et al. garments difficult, if not impossible, for a disabled person to don and remove.

The succeeding patent is also used in the trouser prior art section of my patent application.

U.S. Pat. No. 4,644,589 to Pettis, 1987 Feb. 24, describes self-administrable garments for arthritic persons, comprising a sleeveless vest. Permanently closed shoulder straps are disclosed. Although the front of the Pettis upper garment or vest is openable, using the pressure sensitive fastener combination of hooks and loops, the need to raise one's arms above their head, or behind their back to put their arms through the permanently closed shoulder straps to don this garment would cause the arthritic, or disabled individual discomfort and pain. There is a definite need for a garment that is self-administrable. This garment does not fill that need. As with the heretofore mentioned patents, either bending over or bringing one's knees to the individual's face is required, or assistance will be necessary, taking away the individual's independence and ability to live on one's own.

Underwear:

U.S. Pat. No. 1,966,060 to Cohen, 1932 Jul. 10, discloses bifurcated knee-length undergarment, with a waist-encircling band, attesting to the need for an adjustable undergarment.

U.S. Pat. No. 4,051,854 to Aaron, 1977 Oct. 4, discloses a panty diaper for babies.

U.S. Pat. No. 5,049,145 to Flug, 1991 Sep. 17, discloses diaper cover and diaper with self-closure hook and loop fasteners.

U.S. Pat. No. 5,112,326 to Quadrini, 1992 May 12, discloses adjustable diaper as underwear.

U.S. Pat. No. 5,624,428 to Sauer, 1997 Apr. 29, discloses absorbent article having a pant like pull down feature, with an expansion waist of at least 20 percent. There is a need for a reusable undergarment that allows the individual to adjust the garment to one's own body requirements. This article does not answer this need.

U.S. Pat. No. 4,651,353 to Walden, 1987 Mar. 24, entitled "Disposable Patient Pants," discloses a disposable patient pants having a front elastic waistband, and a rear elastic waistband. Joining the front and back waistbands forms a pants top. To affix the waistband, two hands are necessary; one hand holds the front elastic waistband, and the other hand maintains the rear elastic waistband parallel to facilitate the attachment. For the individual suffering from arthritis this would be an arduous task. Furthermore, the Walden garment has side seams running from the waist to the pants bottom. To close the side seams of the garment would require bending forward, turning one's body to the side and engaging the fastener means. For the stiff or impaired individual, bending to the floor to align the side seams would be impossible.

U.S. Pat. No. 4,675,918 to O'Brien, 1987 Jun. 30, describes a one piece brief with hook and pile closures along one side seam and across the crotch, or the front of the crotch. However as with the aforementioned Pettis garment, going to the restroom or allowing a physical examination, would cause the garment to hang loose or fall away leaving the individual completely exposed, feeling vulnerable and embarrassed. Many physically handicapped individuals live alone with no one to aid them in daily dressing or rearrangement of their clothing after a trip to the bathroom or shower. To these persons, the taken for granted, relatively simple task such as donning a garment, becomes overwhelming. Many of these people, in fact, wear no undergarments because they are unable to put these on and take them off without assistance. As is apparent from the above, there is a need for an adjustable undergarment for the physically handicapped individual which is easy to don, position, fasten, remove and is of the non-disposable type. This garment does not fill that need.

In practice the above disclosed patents, although functional, do not answer the need for reusable underwear for the physically challenged.

Skirt:

U.S. Pat. No. 1,283,092 to Critcher, 1918 Oct. 29, discloses a garment with a wraparound skirt. Loosening the wrap part of the garment for a physical examination causes the garment to hang loose or fall away leaving the individual completely exposed, feeling vulnerable and embarrassed.

U.S. Pat. No. 3,859,667 to Roy, 1975 Jan. 14, discloses a garment construction that comprises a waistline arrangement for encircling a wearer's waist in a wraparound effect, applied to pant-sets, shorts, skirted-shorts, and over-skirt or over-shirt pant-set type garments and in general to bifurcate garments having a crotch. This garment being bifurcated would need to be donned in the usual manner, thereby preventing some physically challenged individuals from donning without assistance. To allow a physical examination of the lower torso, the individual must open a crotch zipper, which would be embarrassing and awkward.

U.S. Pat. No. 3,975,777 to Roy, 1976 Aug. 24, discloses a garment of similar construction to Roy U.S. Pat. No. 3,859,667 previously mentioned, initially engaging the zipper teeth into the slide is difficult. The position of this zipper would add a great degree of difficulty. With the disclosure of zippers and/or other fastening means such as slip buckles, a row of snaps or buttons, a belt section that can be made adjustable by fabrication from a length of elastic-and-cloth band, makes this garment troublesome to an individual with physical or dexterity limitations.

U.S. Pat. No. 2,613,363 to Morgan, 1952 Oct. 14, discloses a garment with characteristic freedom of a pantaloon type garment yet has all the advantages of a skirt. As with the aforementioned trousers patents the Morgan patent, although functional, requires bending to the floor or bringing the knee up towards the face to don this garment, which in turn may cause further suffering to the individual.

Life for the handicapped individual is hard and complex. Often disabled persons are frustrated in their efforts to wear conventional apparel. Moreover the need of assistance is often required. Even in the best of circumstances this can be disheartening to those living with handicapped persons. The impaired individuals inability to cope with the outside world, the feeling of being helpless and a burden causes great stress. Disabled individuals wish to live as normal a lifestyle as is permitted by their disability. An individual's need to be self-sufficient has been proven to be of the utmost importance in mental well-being.

While the aforementioned patents provide needed functions, they still lack the ease of donning and removal required by the physically challenged individual. Whether the individual's impairment is through injury or health ailments, reaching to the shoulders, behind one's back or raising the arms above the head, is excruciatingly painful. Movements such as the folding of the limbs, reaching one's feet, bending over, become arduous tasks and sometimes impossible.

For the most part, specialized clothing such as hospital gowns and garments for the impaired are loose, ill fitting, unflattering, revealing and sometimes embarrassing. A positive psychological outlook is well known to the success of many healthcare procedures. Therefore, for the impaired individual, there remains a great need for apparel that meets their functional requirements and satisfies the need of the individual to achieve freedom. There continues to be a need for apparel that is comfortable, aesthetically pleasing, with the ease of donning and removal that allows the individual to function in a normal manner, to be self-sufficient, and maintain their dignity. Apparel that, while it gives independence, also brings the psychological joy of wearing good-looking, adjustable, adaptable clothing.

None of the above inventions and patents, taken either singly or in combination, is seen to answer those needs.

OBJECTS AND ADVANTAGES

Accordingly, several objects and advantages of the present invention are:

(a) to provide clothing which will allow the physically handicapped individuals whose normal dressing abilities and dexterity have been lost, curtailed and/or restricted, to once again dress themselves.

(b) to provide clothing in which it is unnecessary to remove the shoes, bend over, bring the knees toward the face or the face toward the knees, raise the arms above the shoulders, or behind one's back, in order to change clothes.

(c) to provide clothing that is easy on easy off, alleviating the pain and discomfort experienced by the impaired individual when donning conventional garments.

(d) to provide clothing which an impaired individual is able to don without risk of further injury.

(e) to provide clothing for the impaired individual to don on their own without risk of endangering their recovery.

(f) to provide clothing which physically handicapped individuals can facilitate the donning and removal of, once again allowing the wearing of same.

(g) to provide street clothing for the physically challenged to don unassisted. The person who has been, in the past, restricted to the home because he or she chose not to, or could not, negotiate the expenditure required to don clothing compliant as public wear, is now, with this disclosure, enabled once again to spend more time in the outside world.

(h) to provide clothing that has nontraditional access for the impaired individual that is conventional looking, comfortable, and aesthetically pleasing.

(i) to provide clothing which meets the functional requirements of the physically impaired, yet is easy on easy off.

(j) to provide clothing that an individual can put on without the need of assistance, thereby lessening one aspect of the hard and complex life of an impaired, physically challenged individual.

(k) to provide clothing that allows an impaired individual to function in a normal manner, to be self-sufficient and maintain their dignity.

(l) to provide clothing for a person in a cast, that has wearability, is conventional looking, and comfortable, without need of defacing the garment to don.

(m) to provide a garment that allows needed medical procedures to be administered, without removal of the garment, without causing unnecessary exposure, and without feeling vulnerable.

(n) to provide apparel that may be adjusted to fit the person's particular needs, allowing for swelling of the body, weight gain and loss, braces, swollen and atrophied limbs, or bloating during a woman's monthly cycle.

(o) to provide practical apparel that allows the physically restricted person to live as normal a lifestyle as their disability will permit.

(p) to provide apparel for the full figured person that is conventional looking, comfortable, adjustable and easy on easy off.

(q) to provide an adjustable garment applicable to the needs of the female before, during and after pregnancy.

Further; numerous objects and advantages of my invention will become apparent from a consideration of the drawings and ensuing descriptions.

SUMMARY

The present invention is to meet the need in the impaired individual's life to be independent, and to that end, provide clothing that is self-administrable, adjustable, comfortable, and conventional in appearance. The configuration of this present invention removes any need to bend over to don or remove. No need to struggle out of a body/bathing suit, as this suit opens up completely to clad and unclad. The strain of putting on a shirt is eliminated in that it is unnecessary to raise one's arms above one's head or reach behind one's back.

DRAWINGS

Brief Description of Drawing Figures

Figure 3:
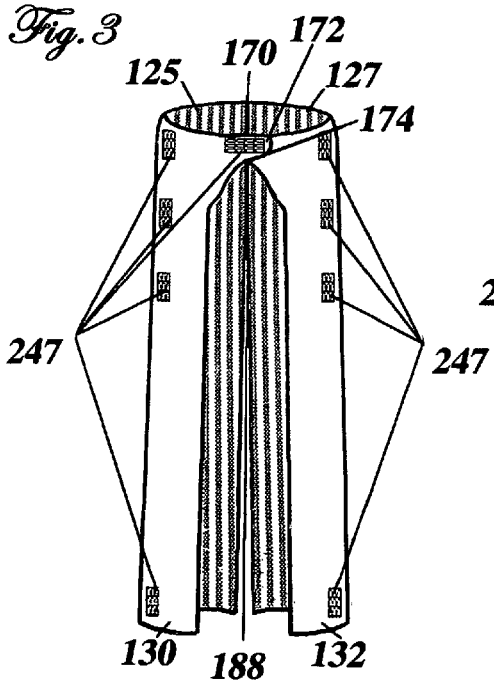

FIG. 3 is the interior right and left joined rear sections of the pants, both sections are lapped and mated at the front abdomen waist area. Upon lapping the right and left rear exteriors are visible. Also complementary fastening materials are indicated.

Figure 4:
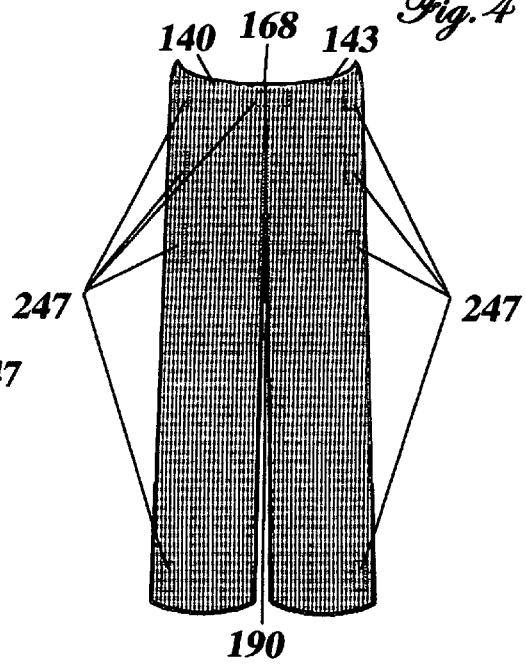

FIG. 4 is right and left joined exterior front of pants.

Figure 5:
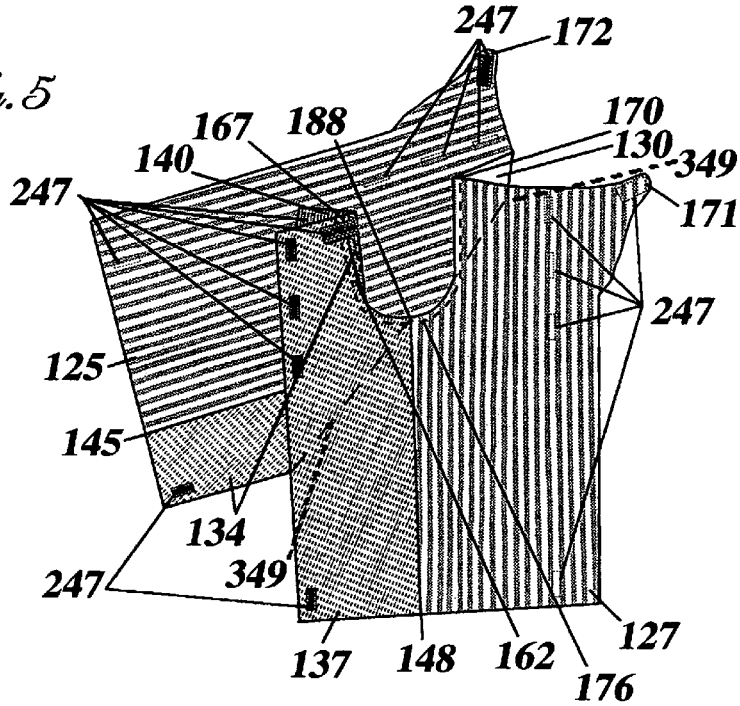

FIG. 5 is an interior view of the pants, the pants are open, the left side laying over the right side.

Figure 6:
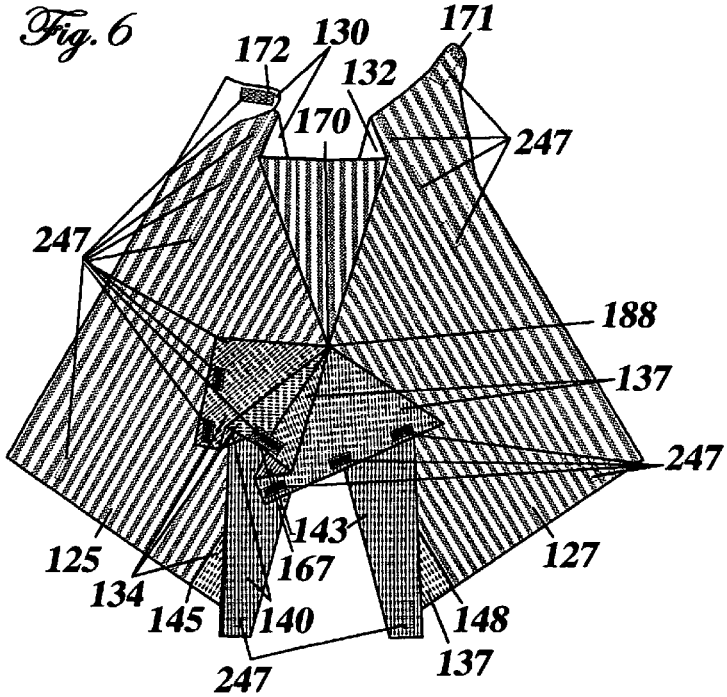

FIG. 6 is an interior view of the pants, right and left rear sections, joined at the crotch to the right and left front sections.

FIG. 7 is an open view of the right and left rear interior of the pants, showing the exterior of the right and left front folded upward.

FIG. 8 shows the right front exterior of the pants, folded upward and secured, over the rear of the garment. The left front is rolled open to show the rear exterior, indicating complementary fastening material.

FIG. 9 is as the aforementioned FIG. 8 with expansion extensions added, an alternative embodiment.

FIG. 10 shows belts or ties attached to exterior rear of pants, an alternative embodiment.

FIG. 11 is a perspective of the pants rear interior showing elastic, an alternative embodiment.

FIG. 12 is a perspective of the pants front, with the waist opened.

FIG. 13 is a perspective of the pants front, with the waist closed.

Figure 14:
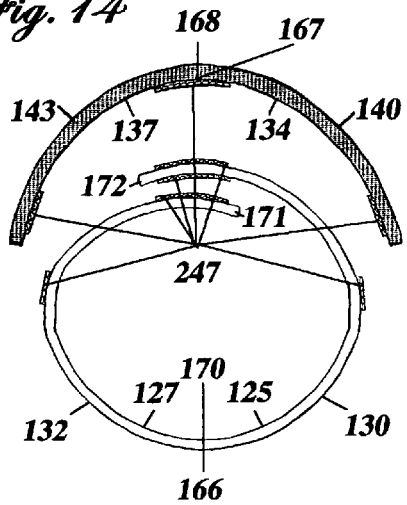

FIG. 14 is a top view of the pants waist.

Figure 15:
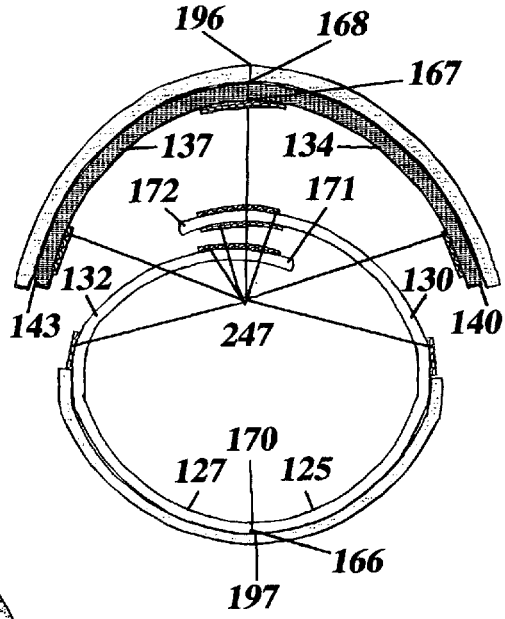

FIG. 15 is a top view of the pants with faux skirt, an alternative embodiment.

Figure 16:
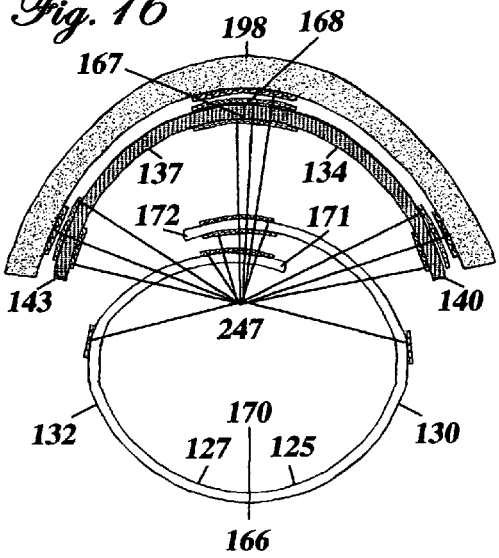

FIG. 16 is a top view of the pants waist with blanket, an alternative embodiment.

Figure 17:
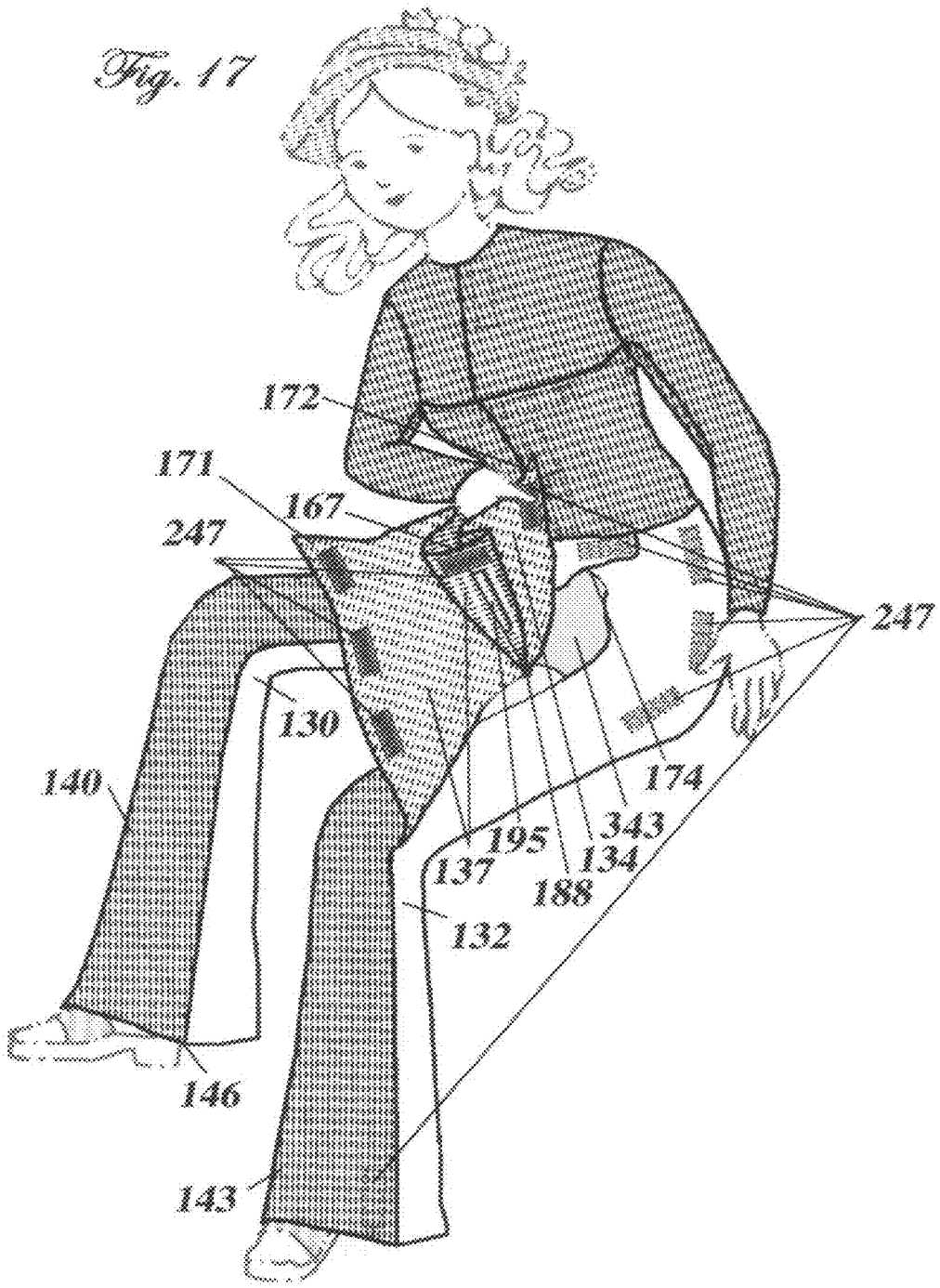

FIG. 17 is the pants, bodysuit and shirt illustrated on an individual.

Figure 18:
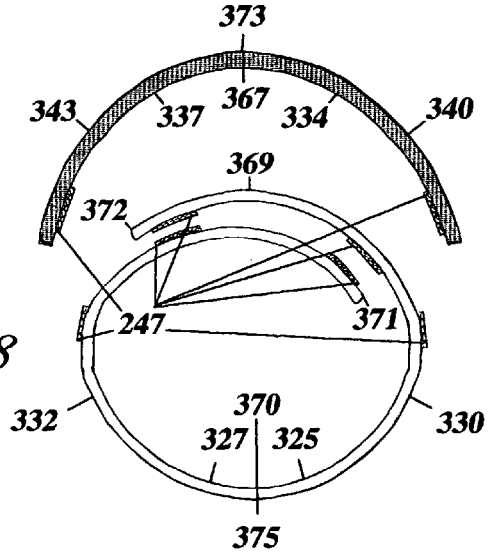

FIG. 18 is the top view of the bodysuit waist.

Figure 19:
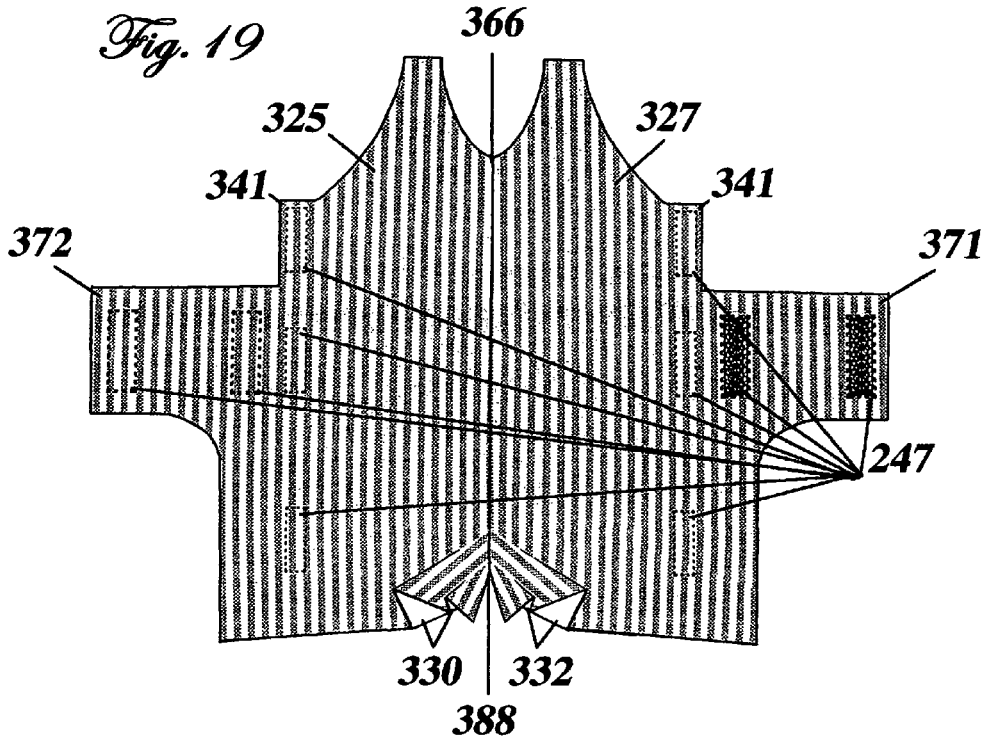

FIG. 19 is a view of the interior right and left joined rear sections of the bodysuit.

Figure 20:
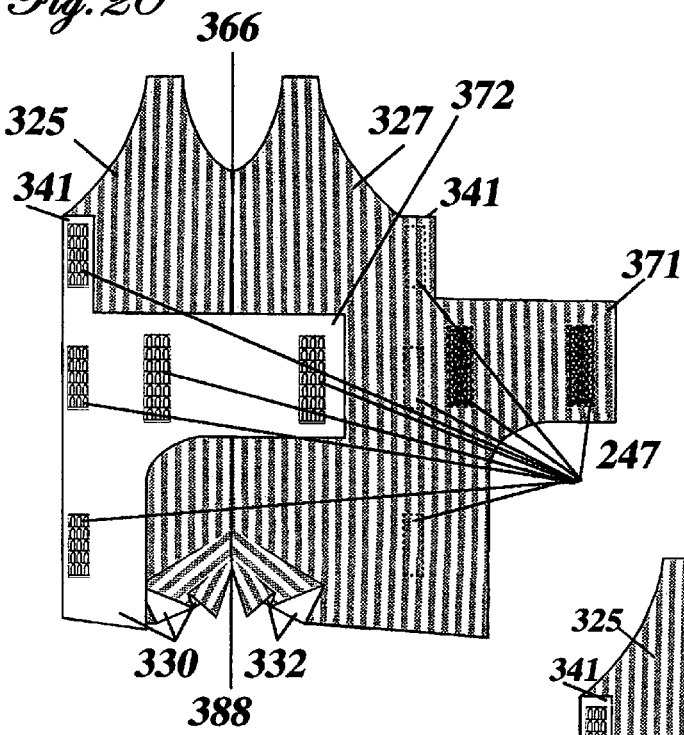

FIG. 20 is a view of the bodysuit interior right and left rear, with the interior right rear section lapping the hip area toward the front. The right rear exterior is displayed upon lapping.

Figure 21:
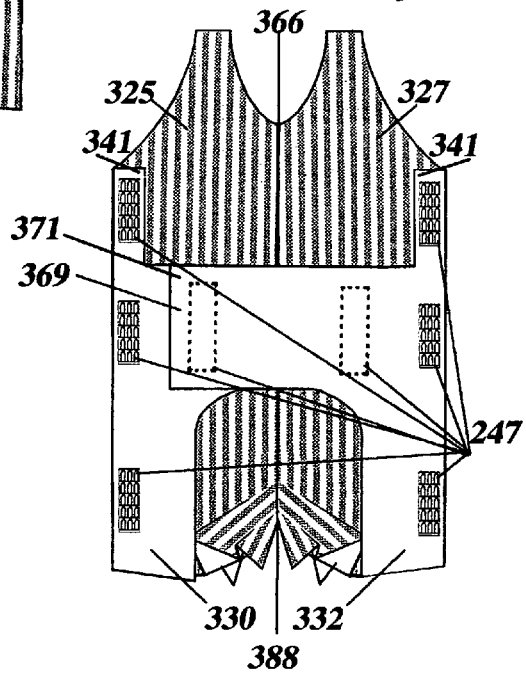

FIG. 21 is the interior right and left joined rear of the bodysuit. Both sections are lapped and mated at the waist in the front abdomen area. Upon lapping the right and left rear exteriors are visible. Also complementary fastening materials are indicated.

Figure 22:
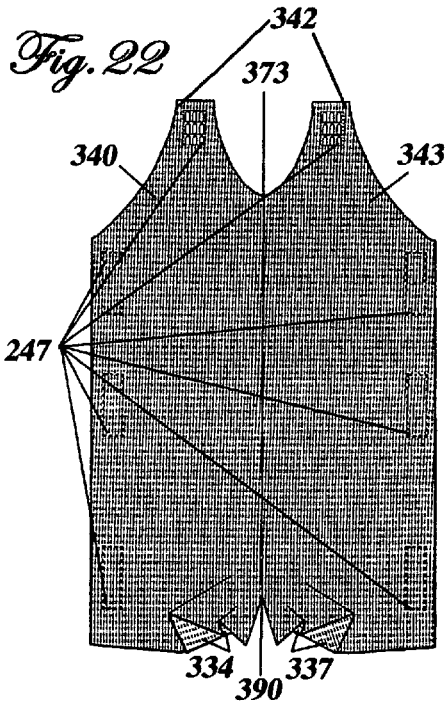

FIG. 22 shows right and left joined exterior front of bodysuit.

Figure 23:
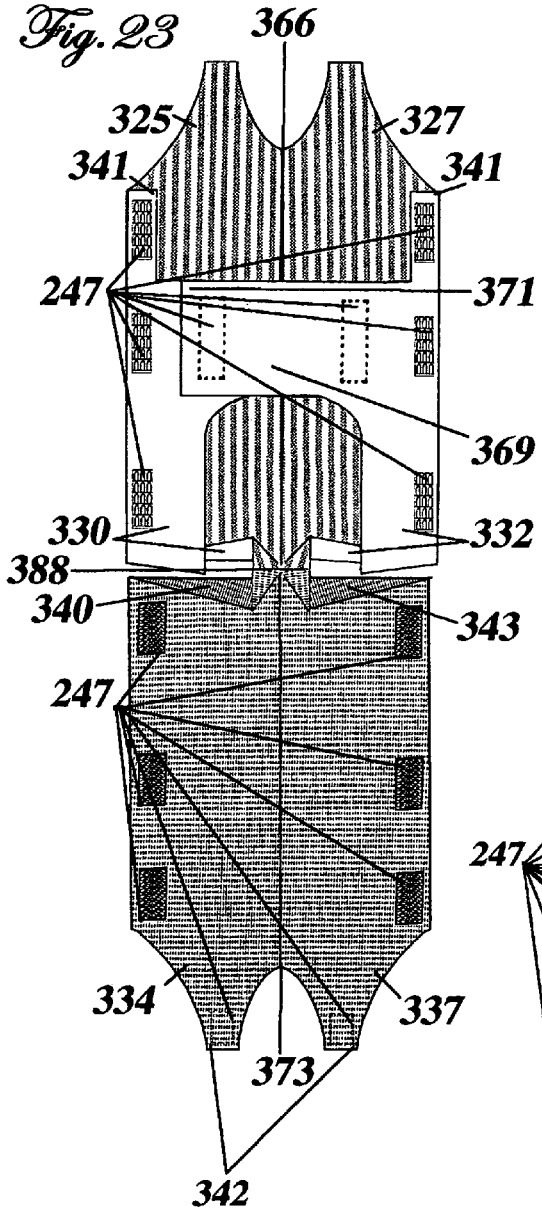

FIG. 23 is an interior view of the bodysuit, right and left rear sections, joined at the crotch to the right and left front sections.

Figure 24:
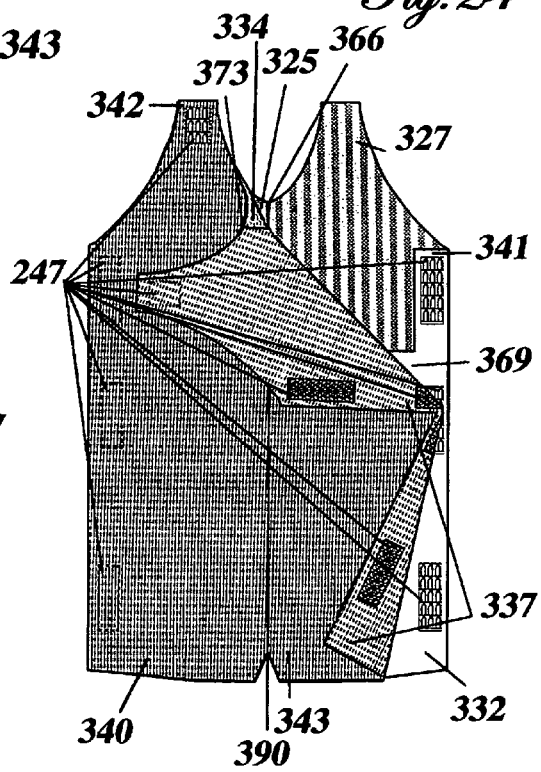

FIG. 24 shows the right front exterior of the bodysuit, folded upward and secured, over the rear of the garment. The left front is rolled open to show the rear exterior, indicating complementary fastening materials.

Figure 25:
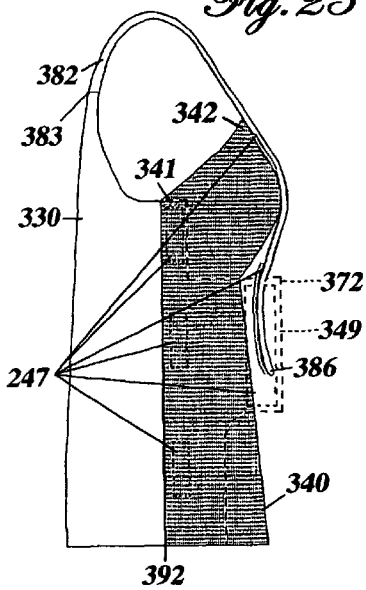

FIG. 25 is a view of the right side of the bodysuit with shoulder strap and hidden lines, with the alternative embodiment of elongated straps.

Figure 26:
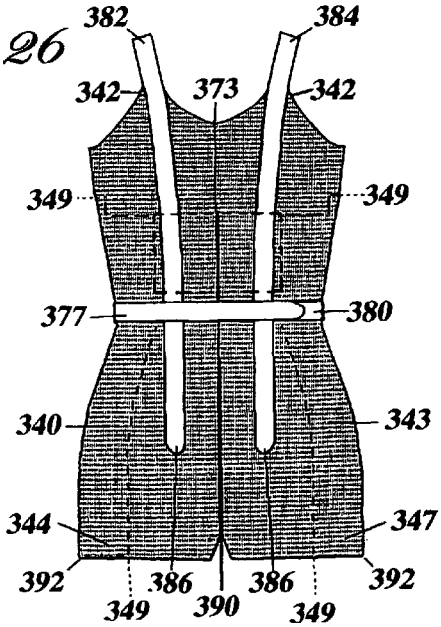

FIG. 26 is a view of the front of the bodysuit with shoulder straps and hidden lines, with the alternative embodiment of torso straps.

Figure 27:
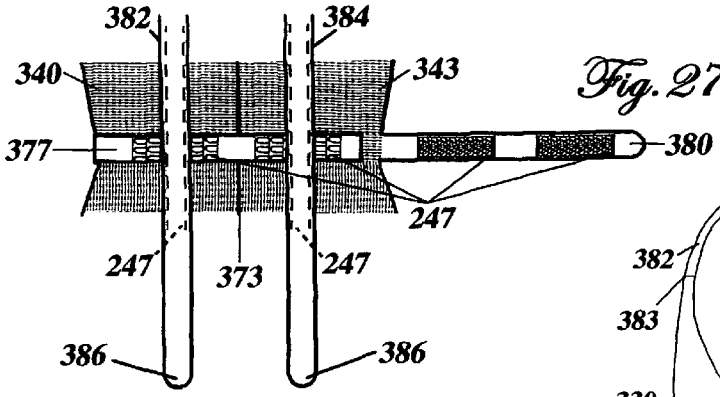

FIG. 27 is a view of the waist of the bodysuit, showing the shoulder straps with the alternative embodiment of torso straps and complementary fastening materials.

Figure 28:
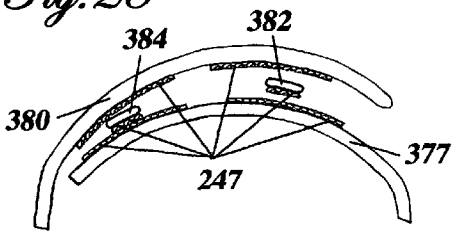

FIG. 28 is a view of the shoulder straps sandwiched between an alternative embodiment, torso straps.

Figure 29:
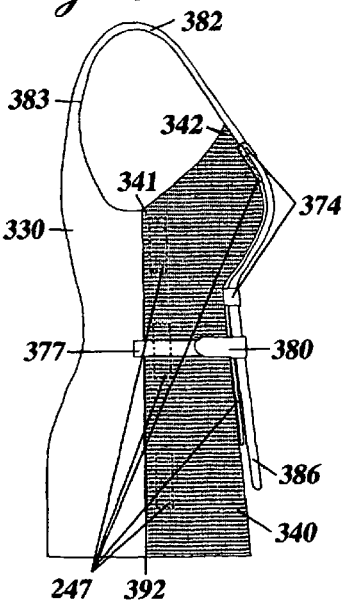

FIG. 29 is a view of the right side of the bodysuit with shoulder straps, showing the alternative embodiments of a torso strap and guiding apparatus.

Figure 30:
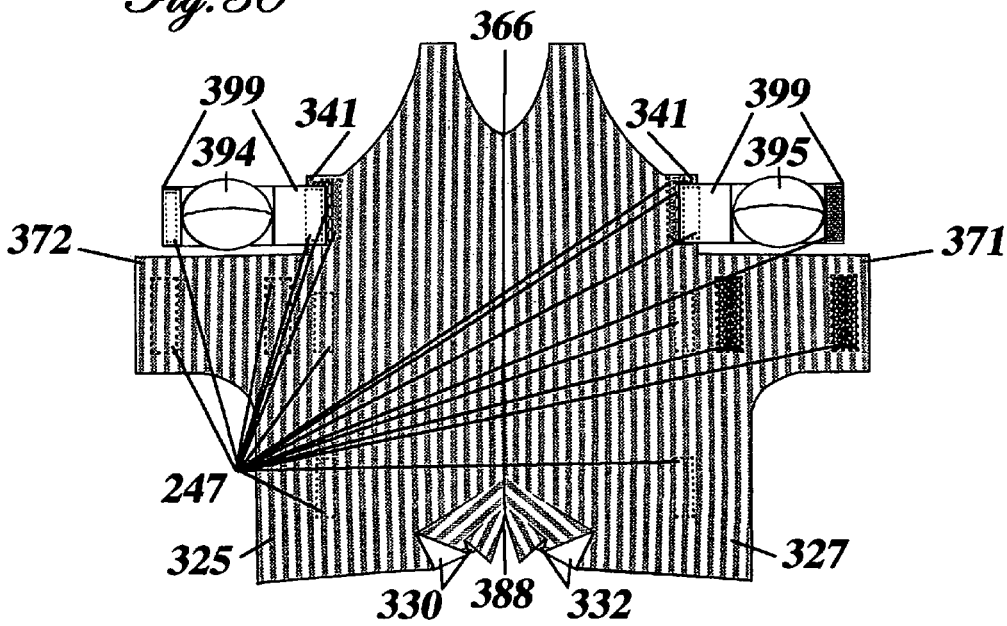

FIG. 30 is the interior right and left joined rear view of the bodysuit with added breast cups, an alternative embodiment.

Figure 31:
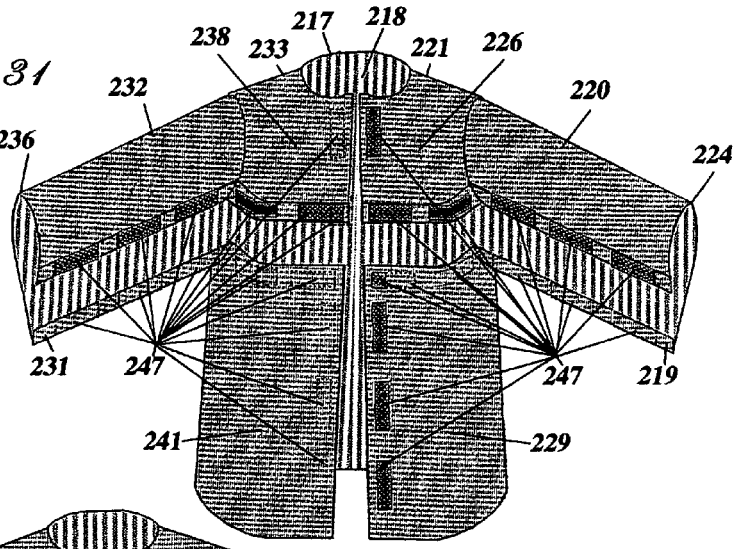

FIG. 31 is a view of the shirt opened.

Figure 32:
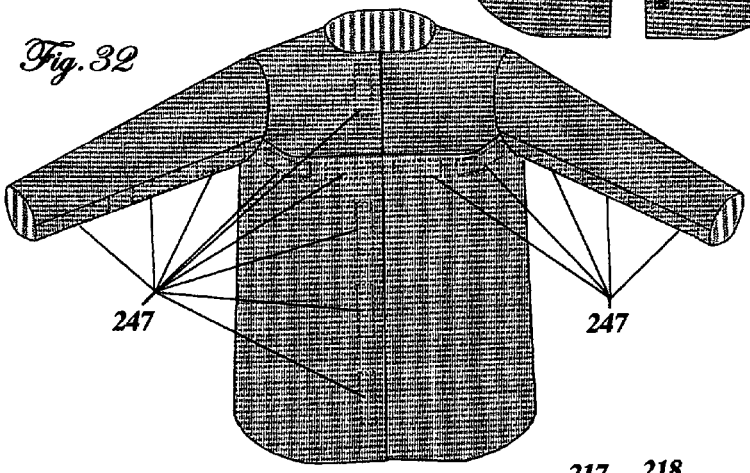

FIG. 32 is a view of the shirt closed.

Figure 33:
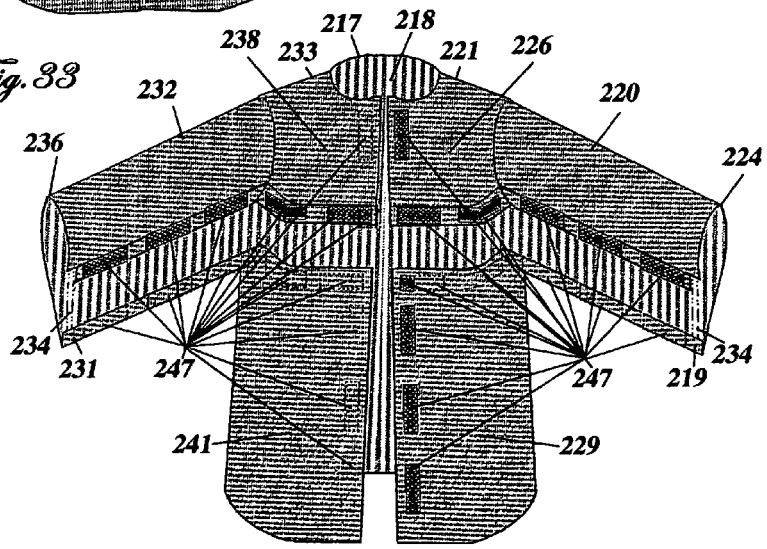

FIG. 33 is a view of an alternative embodiment of the shirt.

REFERENCE NUMERALS

| | |
|---|---|
| | PANTS |
| 247 | Complementary fastening materials (cfm 247) |
| 125 | Right rear interior pants |
| 127 | Left rear interior pants |
| 130 | Right rear exterior pants |
| 132 | Left rear exterior pants |
| 134 | Right front interior pants |
| 137 | Left front interior pants |
| 140 | Right front exterior pants |
| 143 | Left front exterior pants |
| 145 | Right inseam interior pants |
| 146 | Right inseam exterior pants |
| 148 | Left inseam interior pants |
| 162 | Center seam front interior pants |
| 164 | Center seam front exterior pants |
| 166 | Center seam rear exterior pants |
| 167 | Center waist front interior pants |
| 168 | Center waist front exterior pants |
| 170 | Center waist rear interior pants |
| 171 | Waist left rear opposing end pants |
| 172 | Waist right rear opposing end pants |
| 173 | Right extension pants |
| 174 | Partial waist rear pants |
| 175 | Left extension pants |
| 176 | Indication of stitching |
| 177 | Right belt pants |
| 180 | Left belt pants |
| 183 | Right elastic rear pants |
| 185 | Left elastic rear pants |
| 188 | Crotch interior pants |
| 190 | Crotch exterior pants |
| 195 | Fly front |
| 196 | Faux skirt front pants |
| 197 | Faux skirt rear pants |
| 198 | Blanket pants |
| 349 | Hidden/folded lines |
| | BODY SUIT |
| 247 | Complementary fastening materials (cfm 247) |
| 325 | Right rear interior bodysuit |
| 327 | Left rear interior bodysuit |
| 330 | Right rear exterior bodysuit |
| 332 | Left rear exterior bodysuit |
| 334 | Right front interior bodysuit |
| 337 | Left front interior bodysuit |
| 340 | Right front exterior bodysuit |
| 341 | Right and left underarm area |
| 342 | Front apex bodysuit |
| 343 | Left front exterior bodysuit |
| 344 | Right leg bodysuit |
| 347 | Left leg bodysuit |
| 349 | Hidden/folded lines |
| 366 | Center seam interior rear bodysuit |
| 367 | Center waist interior bodysuit |
| 368 | Center waist exterior front bodysuit |
| 369 | Center waist anterior rear bodysuit |
| 370 | Center waist interior rear bodysuit |
| 371 | Center waist end left rear bodysuit |
| 372 | Center waist end right rear bodysuit |
| 373 | Center seam front bodysuit |
| 374 | Guiding apparatus bodysuit |
| 375 | Center seam exterior rear bodysuit |
| 377 | Right torso strap bodysuit |
| 380 | Left torso strap bodysuit |

-continued

| | |
|---|---|
| 382 | Right shoulder strap bodysuit |
| 383 | Attachment of shoulder strap |
| 384 | Left shoulder strap bodysuit |
| 386 | Distal end shoulder strap |
| 388 | Interior crotch bodysuit |
| 390 | Exterior crotch bodysuit |
| 392 | Conventional side seam bodysuit |
| 394 | Right bra |
| 395 | Left bra |
| 399 | Extensions bra bodysuit |
| | SHIRT |
| 247 | Complementary fastening materials (cfm 247) |
| 217 | Back shirt |
| 218 | Interior shirt |
| 219 | Left sleeve bottom shirt |
| 220 | Left sleeve top shirt |
| 221 | Left shoulder shirt |
| 224 | Left cuff shirt |
| 226 | Left chest rib cage front shirt |
| 229 | Left midsection area shirt |
| 231 | Right sleeve bottom shirt |
| 232 | Right sleeve top shirt |
| 233 | Right shoulder shirt |
| 234 | Expandable means shirt |
| 236 | Right cuff shirt |
| 238 | Right chest rib cage front shirt |
| 241 | Right midsection shirt |

DETAILED DESCRIPTION AND OPERATION OF PREFERRED EMBODIMENT

The Pants are illustrated in FIGS. 1-17.

The preferred embodiment of the pants portion is shown in FIGS. 1-8,12,13,14,17.

Alternative Embodiments are shown in FIGS. 9,10,11,15, 16.

The comparative relationship between the pants and the bodysuit operation should be noted.

Figure 1:
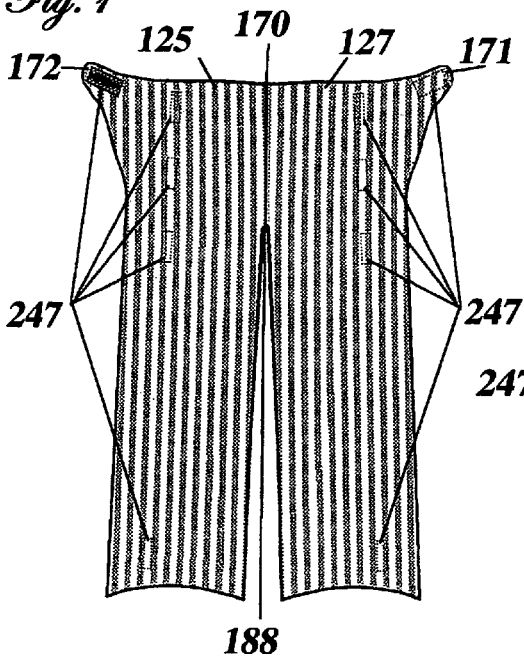
FIG. 1 is a view of the interior right and left joined rear sections of the pants.

FIG. 1 is a view of the right 125 and left 127 joined rear interiors of the pants. Also depicted for clarification; center waist rear interior 170, crotch interior 188, waist right 172 and waist left 171 rear opposing ends, and complementary fastening materials 247. (Which for ease of reading shall be known as cfm 247.)

Figure 2:
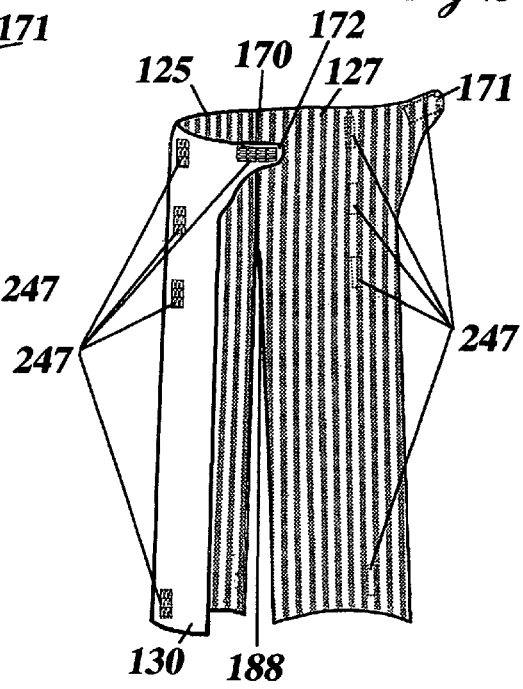
FIG. 2 is a view of the pants interior right and left rear, with the interior right rear section lapping the hip area toward the front. The right rear exterior is displayed upon lapping.

FIG. 2 shows the right 125 and left 127 joined rear interiors, with the right rear interior 125 lapping around the right hip, showing the right rear exterior 130 extending beyond the conventional side seam location toward the individual's abdomen, past the wearer's center front longitudinal line of the torso. Also depicted for clarification; center waist rear interior 170, waist right 172 and waist left 171 rear opposing ends, crotch interior 188, and cfm 247.

FIG. 3 shows the right 125 and left 127 joined rear interiors, lapping around the hips, showing the right 130 and left 132 rear exteriors extending beyond the conventional side seam location toward the individual's abdomen, past the wearer's center front longitudinal line of the torso, with the right 130 and left 132 exteriors overlapping and joined at the partial waist rear pants 174, with cfm 247. Also depicted for clarification; center waist rear interior 170, waist right rear opposing end 172, and crotch interior 188.

FIG. 4 is a view of the right 140 and left 143 joined front exteriors. Also depicted for clarification; center waist front exterior 168, crotch exterior 190, and cfm 247.

FIG. 5 shows the left front interior 137 and left rear interior 127 joined at the left inseam interior 148. The right rear interior 125 and right front interior 134 are joined at the right inseam interior 145. The aforementioned 137 and 127 shall be known as the left interior side, 125 and 134 shall be known as the right interior side. The left interior side and right interior side are joined at the crotch interior 188. Also depicted for clarification; indication of stitching 176, folded fabric hidden lines 349, right front exterior 140, center waist front interior 167, center waist rear interior 170, right 172 and left 171 waist rear opposing ends, right rear exterior 130, center seam front interior 162 and cfm 247.

FIG. 6 shows the crotch interior 188 extending between and connecting the right 125 and left 127 rear interior sections to the right 134 and left 137 front interior sections. The right 140 and left 143 front exteriors are to be folded through the wearer's legs, turned upward, as shown in FIG. 17. Also depicted for clarification; right 145 and left 148 inseam interiors, right 130 and left 132 rear exteriors, center waist rear interior 170, waist right 172 and left 171 rear opposing ends, center waist front interior 167, and cfm 247.

FIG. 7 shows the joined right 125 and left 127 rear interiors, with the front sections, right 140 and left 143, folded through wearer's legs, pulled upward and shown in place covering the abdomen. Waist right 172 and waist left 171 rear opposing ends have not lapped to the front and are not yet secured as shown in FIG. 3. Also depicted for clarification; right 145 and left 148 inseam interiors, crotch exterior 190, right 130 and left 132 rear exteriors, center waist front exterior 168, center waist rear interior 170, and cfm 247.

FIG. 8 shows the combined FIG. 3, which depicts the rear exteriors 130 and 132, lapped and secured, forming the partial waist rear 174 covering the abdomen of the wearer, and FIG. 4 shows the front exteriors 140 and 143 which also cover the abdomen of the wearer. Alignment of FIGS. 3 and 4 forms the legs of the pants. Furthermore the complete waist is formed when the front portion is attached to the back portion, to accomplish this the cfm 247 at the partial waist rear 174 is mated with the cfm 247 of the center waist front interior 167. Also in FIG. 8 the left front exterior 143 is rolled back to show the left rear exterior 132 and the right rear exterior 130. Displaying the alignment of the cfm 247 on the left front interior 137 and the left rear exterior 132, extending along a longitudinal line in the vicinity of the gluteus minimus, sartorius muscle. Mating of such secures closure of the pants. Also depicted for clarification; right 125 and left 127 rear interiors, center waist rear interior 170, waist right rear opposing end 172, right 134 and left 137 front interiors, crotch exterior 190.

FIG. 9 is as FIG. 8 with the addition of right 173 and left 175 extensions, added for expansion. The aforementioned extensions utilize the cfm 247 of the preferred embodiment, along the longitudinal line in the vicinity of the gluteus minimus, sartorius muscle for attachment. The extensions being of appropriate size and material to be compliant with the garment. The adjustability of the partial waist rear 174 allows for this added expansion. Also depicted for clarification; right 134 and left 137 front interiors, center waist front interior 167, right 125 and left 127 rear interiors, center waist rear interior 170, waist right rear opposing end 172, right 130 and left 132 rear exteriors, hidden lines 349, crotch exterior 190, right 140 and left 143 front exteriors.

FIG. 10 is as FIG. 2 with the addition of belts, right 177 and left 180.

FIG. 11 is as FIG. 2 with the addition of right 183 and left 185, rear elastic.

FIGS. 12-16 and 18 show the similarities, and operation of the waist of the pants and the bodysuit. The similarities are: the rear of the garment is lapped and secured around the waist. The front of the garment is folded, pulled through the legs, upward, as stated in the description of FIG. 7.

FIG. 12 is an illustration of the pants waist alignment. The rear exteriors of the pants, right 130 and left 132, are lapped around the hips, extending beyond the conventional side seam location toward the wearer's abdomen, past the wearer's center front longitudinal line of the torso. Opposing ends, rear waist right 172 and left 171 are lapped. The joined right 140 and left 143 front exteriors are shown with the center waist front interior 167 in place for closure as seen in forthcoming FIG. 13. Also depicted for clarification; center waist front exterior 168, center seam front exterior 164, center waist rear interior 170, right 125 and left 127 rear interiors, and cfm 247.

FIG. 13 shows the pants waist as illustrated and described in FIG. 12. The opposing ends, rear waist right 172 and left 171 are lapped and joined forming the partial waist rear 174. The partial waist rear 174 and the center waist front interior 167 are aligned and mated with cfm 247. The cfm 247 extending along the longitudinal line in the vicinity of the right and left gluteus minimus, sartorius muscles are mated, as described in FIG. 8, securing closure of the pants. Also depicted for clarification; center seam front exterior 164, center waist rear interior 170, right 125 and left 127 rear interiors, right 130 and left 132 rear exteriors, right 140 and left 143 front exteriors, and center waist front exterior 168.

FIG. 14 shows the pants waist composition and operation; The rear components; center waist rear interior 170, right 125 and left 127 rear interior, right 130 and left 132 rear exterior, center seam rear exterior 166, opposing ends, waist right rear 172, and waist left rear 171. The front components; right 134 and left 137 front interiors, right 140 and left 143 front exteriors, center waist front exterior 168, center waist front interior 167. The wearer holds the opposing center waist ends 171 and 172 in their hands, pulling same to their front abdomen area, overlapping same, pressing the cfm 247 together securing closure of the back of the pants as shown in FIG. 3.

FIG. 15 shows pants waist as described in FIG. 14 with the addition of an attached faux skirt front 196 and rear 197. Skirt can be detachable if so desired.

FIG. 16 shows pants waist as described in FIG. 14 with added detachable or undetachable blanket 198.

FIG. 17 is an illustration of the wearer donning the pants from a seated position. Showing the right 130 and left 132 rear exteriors lapped and secured, as shown and described in FIG. 3. The right 134 and left 137 front interior sections are folded through the wearer's legs, turned upward, as described in FIG. 7. As in FIG. 8 the consanguinity of the cfm 247 is described. Also depicted; the interior crotch section 188, partial waist 174, right inseam exterior 146, center waist front interior 167, the right 140 and left 143 front exteriors, waist right 172 and waist left 171 rear opposing ends. Also shown the closed shirt as pictured in FIG. 32.

Note: The comparative relationship between the pants and the bodysuit operation are demonstrated in FIGS. 12-18.

Illustrations of the bodysuit are shown in FIGS. 18-30.

The preferred embodiment of the bodysuit portion is shown in FIGS. 18-24.

Alternative Embodiments are shown in FIGS. 25-30.

FIG. 18 is a view of the composition of the rear waist section of the bodysuit, showing center waist rear interior 370, right 325 and left 327 rear interiors, right 330 and left 332 rear exteriors, center seam rear exterior 375, center waist end left rear 371 and center waist end right rear 372. Depicting the front of the bodysuit, right 334 and left 337 front interiors, right 340 and left 343 front exteriors, center waist front interior 367, center waist interior rear 369, center seam front 373 and cfm 247.

FIG. 19 is a view of the right 325 and left 327 joined rear interiors of the bodysuit. Also depicted for clarification; center seam rear interior 366, crotch interior 388, right rear exterior 330, left rear exterior 332, center waist end left rear bodysuit 371, center waist end right rear bodysuit 372, right and left underarm areas 341 and cfm 247.

FIG. 20 shows the right 325 and left 327 joined rear interiors, with the right rear interior 325 lapping around the hip, showing the right rear exterior 330 extending beyond the conventional side seam location toward the individual's abdomen, past the wearer's center front longitudinal line of the torso. Also depicted for clarification; center seam rear interior 366, left rear exterior 332, crotch interior 388, center waist end left rear 371, center waist end right rear 372, right and left underarm areas 341 and cfm 247.

FIG. 21 shows the right 325 and left 327 joined rear interiors, with the right interior 325 and left interior 327 lapping around the hips, showing the right 330 and left 332 rear exteriors extending beyond the conventional side seam location toward the individual's abdomen, past the wearer's center front longitudinal line of the torso, with the right 330 and left 332 exteriors overlapping and joined, forming the center waist rear anterior 369. Also depicted for clarification; center seam rear interior 366, crotch interior 388, center waist end left rear bodysuit 371, underarm areas 341 and cfm 247.

FIG. 22 is a view of the right 340 and left 343 joined front exteriors. Also depicted for clarification; right 334 and left 337 front interiors, crotch exterior 390, center seam front 373, front apex 342 and cfm 247.

FIG. 23 shows the crotch interior section 388 extending between and connecting the right 325 and left 327 rear interior sections to the right 334 and left 337 front interior sections. The wearer pulls the front of the bodysuit through the legs, up toward the abdomen as depicted in FIGS. 6 and 17 of the pants, (noting similarities in the operation of the bodysuit and pants) engaging the cfm 247 completing closure of the torso of the body suit. Also depicted for clarification; right 340 and left 343 front exteriors, center seam rear interior 366, center seam front 373, right 330 and left 332 rear exteriors, center waist end left rear bodysuit 371, front apex 342, underarm areas 341, center waist rear anterior 369, and cfm 247.

FIG. 24 shows the exteriors front right 340 and left 343 have been folded through the wearer's legs, turned upward in the same manner as depicted in the aforementioned FIGS. 6 and 17, bringing the front and rear of the bodysuit into alignment, covering the wearer's abdomen and upper torso. The left front 337 is opened to show FIG. 21. Further showing in FIG. 24 the alignment of the cfm 247, mating of such secures closure of the lower torso of the bodysuit forming the legs. Furthermore joining the cfm 247 at the proximity of the right and left underarm areas 341, an upper torso covering is formed. Also depicted for clarification; right front interior 334, center seam front 373, right 325 and left 327 rear interiors, crotch exterior 390, center seam rear interior 366, center waist anterior rear 369, left rear exterior 332, and front apex 342.

Note similarity to FIG. 8 pants.

FIG. 25 shows the bodysuit from the right side. Depicted under the front exterior, hidden lines 349 representing the right rear exterior of the bodysuit 330 shown lapping the hips, open, not yet mated with cfm 247, as also depicted in FIG. 21. Also shown: the attached right shoulder strap 382, which represents also the left shoulder strap 384 (left not shown) demonstrates the adjustability of the straps. Further explanation will be seen and described in FIGS. 26-29. Also depicted for clarification; right front exterior 340, conventional side seam 392, attachment of shoulder strap 383, distal end shoulder strap 386, center waist end right rear 372, front apex 342 and underarm area 341. Adjustments may be made for weight gain or loss. In some cases extensions, as shown in FIG. 9 pants, may be utilized. The same garment may be worn before, through out, and after pregnancy. Furthermore nursing the baby could be accomplished without disrobing.

FIG. 26 is a view of the front of the bodysuit, right 340 and left 343 exteriors, with the shoulder straps, right 382 and left 384, and torso straps right 377 and left 380, in place, showing closure of the bodysuit. Hidden lines 349 show the rear bodysuit lapped and closed as pictured in FIG. 21. Also depicted for clarification; right leg 344, left leg 347, left and right side seams 392, crotch exterior 390, front apex 342, distal ends 386 of right and left shoulder straps, and center seam front 373.

Noteworthy; FIGS. 25-29, show the comparative relativity between the pants and the bodysuit.

FIG. 27 depicts the front waist of the bodysuit; the right torso strap 377 is crossed toward the left side of the body. The cfm 247 of the right torso strap 377 is mated with the cfm 247 of the right 382 and left 384 shoulder straps. The left torso strap 380 is crossed toward the right side of the body, the cfm 247 of the right torso strap 377, and the left torso strap 380 are united, sandwiching the shoulder straps between the torso straps, also securing closure of the waist front. Moreover the wearer may adjust the cfm 247 to their own comfort, allowing the bodysuit to accommodate a person's needs and diverse sizes. As stated heretofore, FIGS. 25-29 pertain to the waist and straps. Also depicted for clarification; right front exterior 340, left front exterior 343, center seam front 373, and distal end strap 386.

FIG. 28 is an overhead illustration of the torso straps, left 380 and right 377, the left 384 and right 382 shoulder straps in place, depicting the conjunction of the cfm 247, portraying the shoulder straps sandwiched between the torso straps. The relationship between FIGS. 25-29, show the flexibility of the torso straps and shoulder straps to move side to side, up and down the cfm 247 to adapt the garment to the circumstances of the individual.

FIG. 29 is similar to FIG. 25 in which the bodysuit is shown from the right side. Showing the cfm 247 as described in FIG. 24 mated, securing closure of the bodysuit. The shoulder strap right 382 is directed through a guiding apparatus 374, sandwiched between the right torso strap 377, and left torso strap 380, as pictured in FIG. 28. Also depicted for clarification; right front exterior 340, right rear exterior 330, attachment of strap 383, distal end shoulder strap 386, front apex of the bodysuit 342 and underarm area 341.

As previously referenced, FIGS. 25-29 are relevant to the waist, torso straps and shoulder straps.

FIG. 30 is as described in FIG. 19 showing the opened bodysuit rear interiors right 325 and left 327, with the addition of a permanently placed or detachable brassiere. To attach the brassiere permanently, one end of the brassiere extensions 399 is installed at the respective right or left interior underarm 341 area. If detachability is desired, the utilization of cfm 247 at the interior underarm area of the bodysuit, and the respective right or left exterior brassiere extensions 399 would be utilized, allowing removal and attachment of the brassiere at the underarm area. The right 394 and left 395 brassiere extensions 399 having cfm 247 at the center chest sternum area, allowing adjustable closure of the brassiere. Also depicted for clarification; center seam interior rear 366, crotch interior 388, center waist end left rear bodysuit 371, center waist end right rear bodysuit 372, right 330 and left 332 rear exteriors. The flexibility of the bodysuit allows adjustment to address a person's extenuating circumstances.

The preferred embodiment of the shirt portion is shown in FIGS. 31 and 32.

Alternative Embodiment is shown in FIG. 33.

FIG. 31 is a view of the front of the shirt, opened. This embodiment is a conventional looking shirt for a person in need of assistance to don. Placing the easy to fasten shirt on a reclining wearer is very much like changing bed sheets around a patient; rolling the patient onto his side, the shirt is placed flat in the area of the patient's original position, the patient is rolled back onto the shirt, the shoulder sections 233 and 221 are pulled onto the shoulders. The sleeve sections left 220 and right 232 of the shirt are being wrapped at the same time, bringing the sleeves and chest sections right 238 and left 226 into place. The shirt has a continual horizontal opening extending from the right cuff 236, which runs the entire length of the sleeve, across the front of the shirt, between the top right 238 and left 226 and the bottom right 241 and the left 229 to the left cuff 224. Having a plurality of cfm 247 on the right top 232 and bottom 231 and the left top 220 and bottom 219; mating of the cfm 247 secures closure of the sleeves. The shirt front is divided into four sections: right chest rib cage 238, left chest rib cage 226, right midsection 241, left midsection 229, all having a plurality of cfm 247. This prudent design is to provide the advantage to the assistant of wrapping the garment on the individual without the need to remove the patient from the bed. Mating of the cfm 247 at the right chest rib cage 238, to the left chest rib cage 226, secures the top portion of the garment. For definitional purposes 238 and 226 shall be called the top. Mating of the cfm 247 of the right midsection 241, to the left midsection 229, secures the bottom portion of the garment. For definitional purposes 241 and 229 shall be called the bottom. Joining the bottom of the shirt to the top now secures closure of the shirt body, successfully completing the donning of the shirt. Also depicted for clarification; back of shirt 217 and interior 218.

FIG. 32 is a view of the shirt closed, indicating the mated plurality of cfm 247.

FIG. 33 is a view of an alternative embodiment of the shirt. This embodiment is for the physically handicapped individuals wishing to clad themselves in standard looking clothing without assistance. The shirt has a continual horizontal opening running from the right cuff 236 with expandable means 234, which extends the entire length of the sleeve, across the front of the shirt to the left cuff 224 with expandable means 234. The sleeves are divided, right top 232 and bottom 231, left top 220 and bottom 219, each section having a plurality of cfm 247. The shirt front is divided into four sections: right chest rib cage 238, left chest rib cage 226, right midsection 241, left midsection 229, all having cfm 247. The reason for this configuration is to provide the advantage to the individual of self-donning the garment, without reaching behind one's back or above the shoulders. As a practical matter the shirt is attached at the cuffs 236 and 224 of the sleeves with expandable means 234, the back 217 is at all times graspable, it does not fall out of reach as in aforementioned prior art. Laying the shirt on the bed, the individual places his or her hands through the expandable means at the cuff area, pulling the left sleeve with the right hand, the right sleeve with the left hand, working up the sleeves toward the neck, pulling the shoulders 233 and 221 of the shirt onto the shoulders. Mating of the cfm 247 at the right chest rib-cage 238, to the left chest rib-cage 226, secures the top portion of the garment. For definitional purposes 238 and 226 shall be called the top. Mating of the cfm 247 of the right midsection 241, to the left midsection 229, secures the bottom portion of the garment. For definitional purposes 241 and 229 shall be called the bottom. Joining the bottom of the shirt to the top now secures closure of the shirt body. Joining the plurality of cfm 247 on the right sleeve top 232, to the right sleeve bottom 231, and the left sleeve top 220, to the left sleeve bottom 219 secures closure of the sleeves, successfully completing the donning of the shirt. Also depicted for clarification: interior 218.

The advantages and flexibility provided by the aforementioned allows the wearer to don the garment without assistance.

Operation and Description of Preferred Embodiments

To facilitate the impaired individual's unassisted donning of the pants, the joined rear sections of the pants as shown in FIG. 6 interior left 127 and right 125 are spread (exterior side down) on the bed. The individual places their pelvis area on the interior crotch 188 of the pants. In FIG. 7 the left 171 and right 172 opposing rear waist end sections are shown. In FIG. 8, left 171 (not shown) and right 172 opposing rear waist ends are overlapped at the abdomen waist area, a partial waist rear 174 is formed upon fastening the cfm 247.

The front sections 140 and 143, shown in FIG. 6, are attached to the rear sections at the crotch 188, bringing the front sections between the legs, turning upwardly towards the abdomen as shown in FIG. 8, overlaying the center waist front interior 167 over the rear sections partial waist 174, brings the torso into alignment, at the same time the legs are formed. Mating the cfm 247 of the center waist front interior 167 and the partial waist rear 174 forms a complete waist. The mating of the cfm 247 along the longitudinal line at the conventional side seam areas completes the donning of the pants.

As a practical matter; if the individual uses a wheel chair, the pants may be placed on the wheel chair seat, the person sits in the wheel chair, positioning the pelvis area over the pants interior crotch area 188, the wrapping and closure of the left 171 and right 172 waist rear opposing ends forms the partial waist rear 174. Pulling the left and right joined front section through the crotch area 188, attaching the cfm 247 of the center waist front interior 167 to the cfm 247 of the partial waist rear 174 secures closure of the pants. This procedure can be accomplished by the individual with no need of assistance.

Placing the easy to fasten pants on a reclining individual is very much like changing bed sheets around a patient; the patient may be rolled onto his side, the pants may be placed flat in the area of the patient's original position, the patient may be rolled back onto the pants and the pants may be lapped and closed in the same manner as mentioned heretofore. This prudent design is to provide the advantage to the assistant of wrapping the garment on the individual without the need to remove the patient from the bed.

Likewise these pants may be self-donned by a wearer in a standing position. The donning of the pants is achieved without the patient ever having to lift even one foot up off the floor and/or removing one's shoes. The present easy to don pants are particularly well suited to the individual who cannot comfortably maintain his or her balance while putting trousers on in the ordinary way.

Those yearning to conserve their strength, cause no further harm or pain to themselves, wishing to keep their dignity and independence, will find that the nature of these functional pants will aid the wearer to that avail.

The bodysuit is donned in much the same manner as the pants. The bodysuit is spread out fully as depicted in FIG. 23 (with center waist ends 371 and 372 {not shown} not yet lapped) the individual places their pelvis area on the interior crotch 388 of the bodysuit. The wearer holds the center waist ends 372 and 371 in their hands, pulling same to their front abdomen area, overlapping same, pressing the cfm 247 together securing closure of the rear of the bodysuit, forming center waist anterior rear bodysuit 369.

Further showing in FIG. 23, the left 334 and right 337 front sections are brought between the legs, turning upwardly towards the abdomen, thus lapping said left and right front sections over the rear center waist anterior rear 369, bringing into alignment the torso of the bodysuit, forming the legs. Mating and closure of the cfm 247 along the longitudinal line at the conventional side seam areas and the joining and closure of cfm 247 at the front apex of the bodysuit 342 with the left 384 and right 382 shoulder straps, complete the donning of the bodysuit, as depicted in FIGS. 25 and 27.

Understandably the bodysuit may be donned standing, sitting, or lying down as with the aforementioned pants. Adjustments may be made for weight gain or loss. The same garment may be worn before, throughout, and after pregnancy. Furthermore nursing the baby could be accomplished without disrobing. Placing the easy to fasten shirt on a reclining individual is very much like changing bed sheets around a patient; rolling the patient onto his side, the appropriate side of the shirt is placed flat on the bed in the area of the patient's original position, the remainder of the shirt is tucked against the patient's back, the patient is then rolled back onto the shirt, the tucked remainder of the shirt is fully opened on the bed, and the patient is rolled back to a flat position on the shirt. The shoulder sections 233 and 221 are pulled onto the patient's shoulders. The sleeves are now in alignment for closure. The cfm 247 of the sleeves are mated. The shirt front top and bottom cfm 247 are aligned and mated securing closure of the shirt.

Detailed Description and Operation of Alternative Embodiments

An alternative embodiment of adding a fly to the pants will accommodate use by a male or female.

An alternative embodiment of adding right 173 and left 175 extensions to the pants may be utilized to accommodate a persons fluctuating size as shown in FIG. 9.

An alternative embodiment of the shirt of adding a cuff expander/closure represented in FIG. 33 as expandable means 234 will facilitate the donning of the shirt by the unassisted wearer desiring independence.

To don the shirt the unassisted individual places the exterior back of the shirt on the bed, sitting on the bed with the shirt laying behind him or her the individual puts their left hand through the expandable means 234 at the left cuff 224 and the right hand through the expandable means 234 at the right cuff 236, crossing the arms across the body, grasping the left sleeve 220 with the right hand and right sleeve 232 with the left hand, proceeding to move the hands up toward the shoulders, pulling and working the sleeves toward the front of the arms and body, working toward the neck area brings the shirt's shoulders into alignment with the shoulders of the wearer.

The alignment and closure of the cfm 247 on the longitudinal line from the cuff of the first sleeve to the cuff of the opposing sleeve, which crosses the chest, and the alignment and closure of the cfm 247 on the vertical line of the sternum area completes the unassisted donning of the shirt, restoring independence and self-reliance.

An alternative embodiment to the bodysuit is to elongate the straps 382 and 384 to facilitate the donning of the bodysuit by the unassisted wearer. The elongated straps are placed across the forearms, pulled forward, thus pulling the back of the bodysuit up the back of the body toward the neck, whereby the garment being pulled into place from the front of the body alleviates the need to reach behind one's back or lift one's arms above the shoulders, thereby restoring independence.

As an alternative embodiment of the bodysuit, extensions (as shown in FIG. 9 of the pants, extensions 173 and 175) may be utilized to accommodate a person's fluctuating size or pregnancy.

The extensions being of appropriate size and material to be compliant with the garment. In the case of pregnancy, if needed, these extensions would enable the woman to wear the suit throughout her pregnancy.

CONCLUSION, RAMIFICATIONS, AND SCOPE OF INVENTION

While the above illustrations and descriptions contain many specificities, it should be understood that the present disclosure is to be an exemplification of the principles of the invention and should not be construed as limitations on the spirit and scope of the invention and/or claims of embodiments illustrated, but rather as an exemplification of one preferred embodiment, along with alternative embodiments thereof. However numerous embodiments, modifications, and variations are possible.

For example; the legs of the bodysuit may be cut high or low, likewise the bodysuit may be a bathing suit, either a one piece or a two-piece. In addition a bathing suit is hard to fit, if the bottom of the suit is the correct size, the bra size might be incorrect or vice versa. This garment, if a breast cup is desired, allows the wearer to select her exact breast cup size. The bodysuit straps may be of a length to accommodate the needs and wants of the individual, the inclusion of a guiding apparatus may be desired. Adjustments may be made for weight gain or loss, varying breast and hip sizes. The same garment may be worn before, throughout, and after pregnancy. Furthermore nursing the baby could be accomplished without disrobing.

The legs of the lower torso-covering garment may be of any length, causing them to be known as trousers, shorts, capris, pedal pushers, leggings, girdle, etcetera. A standard fly may be added to accommodate both male and female, depending on the needs and/or wishes of the individual whether it be ornamental or functional. Belts and/or belt loops may also be utilized. The legs may be tapered, bell-bottom, flared, or of any style desired. The shirt may be made in many styles thereby calling it a blouse, a jacket, a coat, etcetera. Also the sleeves may be of a length or width, or style desired to satisfy the needs and wants of the individual.

The shirt, and/or bodysuit, may be combined, including or excluding the pants in any manner pleasing to the individual, according to desire and need, to form lingerie, a playsuit, pajamas, or sleeping apparel. In the same manner, the shirt portion and the pants portion combination may be combined to form coveralls, overalls, a jumpsuit, a boilersuit or the like. A conventional shirt could be added at the waist of the pants to form a coverall, overall, jumpsuit, a boilersuit or the like for the less impaired individual. The adjustability and the configuration of my apparel, does away with the disadvantage of the ingress and egress of the jumpsuit type garment and like apparel. The aforementioned garments may be outerwear or underwear. Accordingly the aforementioned embodiments could be oversized allowing an individual an outer garment, as well as an inner garment and an under garment to be worn at the same time, therefore the individual who had been restricted to waiting for assistance, to don their apparel, will have the independence of dressing one's self with all the necessary clothing needed to function in society.

Various fabrics of any color, such as silk, or linen, materials such as denim, poplin, sailcloth may be used to make casual or dress up garments, other material such as terrycloth may be used to mimic a robe-like garment. In order to protect from inclement weather the aforementioned apparel may be composed of materials designed for that purpose. Any weight of fabrics, materials, natural or synthetic, paper-related and other disposables may be used to manufacture the aforementioned articles. A faux skirt, known as a scooter, skorts, or culottes or the like, could be added to the pants portion to accommodate a feminine look. In the same manner as adding a faux skirt, a blanket could be added to accommodate a wheel-chair bound person, to keep them warm, and covered, the use of complementary fastening materials would keep it in place. The blanket could be made of any weight fabric in accordance with the weather. These augmentations may be added permanently or temporarily.

Further; the use of the complementary fastening materials, would include, and does not preclude using any and all types of fasteners such as zippers, buttons, hook and eyes, rivets, snaps, etc.

Diverse stitching methods may be employed in construction of the aforementioned embodiments, not necessarily including or excluding, for example, French seams, flat felled seams, top stitch, zig-zag stitch, straight stitch, including any and all forms of construction methods, desired or needed.

Trims, accessories and designs of any sort, such as pockets, cuffs, collars, beads, lace, ribbon, fringe, belts, loops, straps, elastic, thread, yarn, etcetera, may be added to increase functionality, and to style the garment to individual tastes, wants and needs. Where overlap is utilized, the garments may be constructed with right to left, and/or left to right crossover, the overlap may be made shorter, longer, narrower or wider. A bottom over top and/or a top over bottom closure may be employed where and when deemed to be most beneficial.

The garments are readily adaptable to size and adjustment to meet the requirements of the wearer. Accordingly any and all expansion techniques may be utilized, including, expandable material, self fastening material, elastic, hook and loop, multiple buttons and button holes, expansion extensions, etc.

It will be further determined that the invention shown and described herein will be recognized, understood, appreciated and used by persons, in all walks of life, adults, or children, whether handicapped, or able-bodied.

Moreover, it is to be understood that certain features and variants may be used to advantage with or without a corresponding use of other features thereof, including but not limited to full and partial openings in different locations on the garments.

From the foregoing detailed description it will be recognized and understood that numerous modifications and concepts may readily be utilized as a basis for the designing of other structures, methods and systems for carrying out several purposes of the present invention without departing from the spirit and scope of the invention.

It will be appreciated and become apparent to those skilled in the art, that the foregoing examples illustrated, upon conception in which this disclosure is based, are but a few of the possible ways to carry it out, the range is unlimited. Shirts, blouses, pants, play suits, shorts, and swim suits, are but a few possible combinations, sport coat and suit combinations, athletic outfits, and many casual fashions and even formalwear may be adapted to the inventive outfit. The descriptive and illustrative materials employed herein are utilized for purposes of exemplifying, not limiting the invention. The full extent of the spirit and scope of the invention should in no way be limited to, or be determined by the details of such embodiments. Thus the scope and spirit of the invention are intended and should be determined by the appended claims and their legal equivalents, to cover all such diversities as would occur rather than the examples given.

The invention claimed is:

1. A pair of pants comprising:

a rear section having a top torso portion and bottom leg sections, interior and exterior surfaces, and left and a right sides, said left and right sides extending beyond a conventional side seam location and wrapping around a wearer toward a front center longitudinal line of the wearer, the top torso portion having a left extension extending from the left side and a right extension extending from the right side, wherein both the left and right extensions comprise fasteners located on the exterior of the extensions and one of the left or right extensions comprise an additional fastener on the interior of the extension, wherein one of the external fasteners on one of the left or right extensions mates with the interior fastener located on the other of the left or right extensions forming a portion wrapping completely around a wearer's waist, said left and right sides comprising a plurality of couplers extending into the leg sections, each coupler located in a longitudinal line at a position laterally offset from the sides on the exterior surface of the rear section;

a front section having a top torso section and bottom leg sections, interior and exterior surfaces, and left and a right sides, said top torso portion of said front section comprising a fastener on the interior surface so as to mate with the other of the exterior fasteners located on the exterior of one of the extensions wherein mating the fasteners forms a complete torso section for covering the lower torso of a wearer, said front section interior surface comprising a plurality of complimentary couplers that mate with the couplers located on the exterior surface of the rear section forming complete tubular leg portions for covering the legs of a wearer; and an inseam connecting said front and rear leg sections together and creating a crotch section.

2. A bodysuit comprising:

a rear section having shoulder strap portions, a torso portion and partial leg covering portions, interior and exterior surfaces, and left and right sides extending from the partial leg covering portions upwards to a top portion, wherein the top portion is in a location corresponding to an underarm area of a wearer, said left and right sides extending beyond a conventional side seam location and wrapping around a wearer toward a front center longitudinal line of the wearer, the torso portion having a left extension extending from the left side and a right extension extending from the right side, the extensions being located at a location between the leg covering portions and the top portion, one of the left or right extensions having fasteners located on the exterior of the extension and the other one of the left or right extensions having fasteners on the interior of the extension, wherein the external and internal fasteners on the left and right extensions mate with each other forming a portion wrapping completely around a wearer's torso, said left and right sides comprising a plurality of couplers extending from the top portion into the leg portions in a longitudinal line on the exterior surface of the rear section, and said shoulder strap portions comprising a plurality of couplers located on the exterior surface of the rear section;

a front section having shoulder strap portions, a torso portion and partial leg covering portions, interior and exterior surfaces, and left and right sides extending from the partial leg covering portions upwards to a top portion, wherein the top portion is in a location corresponding to an underarm area of a wearer, said front section interior surface comprising a plurality of complimentary couplers that mate with the couplers located on the exterior surface of the rear section forming a complete bodysuit for covering a portion of a wearer's shoulders, the torso and a portion of the wearer's legs; and a crotch section connecting said front and rear sections together between the leg covering portions.

3. The bodysuit of claim 2, further including torso straps extending from the rear section at a location substantially midway between the top portion and the leg covering portions and at a location corresponding to a conventional side seam location.

4. The body suit of claim 3, wherein said torso straps having complementary fastening materials.

5. The bodysuit of claim 2, further comprising a plurality of guiding apparatuses on the front section.

6. The bodysuit of claim 2, wherein said rear section at the top portion of each of the left and right sides comprise left and right breast cups, wherein said left and right breast cups extend from the sides of the body suit towards the front center of the wearer, each breast cup having a fastening element on one end that mate with each other at the center of the wearer forming a complete breast encircling portion.

7. A clothing combination with non traditional access for impaired individuals comprising:

a pair of pants having a pants rear section having a top torso portion and bottom leg sections, interior and exterior surfaces, and left and a right sides, said left and right sides extending beyond a conventional side seam location and wrapping around a wearer toward a front center longitudinal line of the wearer, the top torso portion having a left extension extending from the left side of said pants and a right extension extending from the right side of said pants, wherein both the left and right extensions of said pants comprise first fasteners located on the exterior of the extensions and one of the left or right extensions of the pants comprise an additional first fastener on the interior of the extension, wherein one of the external first fasteners on one of the left or right extensions mates with the interior first fastener located on the other of the left or right extensions forming a portion wrapping completely around a wearer's waist, said left and right sides of said pants comprising a plurality of second fasteners extending into the leg sections, each second fastener located in a longitudinal line at a position laterally offset from the sides on the exterior surface of the pants rear section;

a pants front section having a top torso section and bottom leg sections, interior and exterior surfaces, and left and a right sides, said top torso portion of said pants front section comprising at least one complimentary first fastener on the interior surface so as to mate with the other of the exterior first fasteners located on the exterior of one of the extensions of said pants wherein mating the first fasteners forms a complete torso section for covering the lower torso of a wearer, said pants front section interior surface comprising a plurality of complimentary second fasteners that mate with the second fasteners located on the exterior surface of the pants rear section forming complete tubular leg portions for covering the legs of a wearer;

a pants inseam connecting said front and rear leg sections of said pants together and creating a crotch section in the pants;

a bodysuit having a bodysuit rear section having shoulder strap portions, a torso portion and partial leg covering portions, interior and exterior surfaces, and left and right sides extending from the partial leg covering portions upwards to a top portion, wherein the top portion is in a location corresponding to an underarm area of a wearer, said left and right sides of said bodysuit extending beyond a conventional side seam location and wrapping around a wearer toward a front center longitudinal line of the wearer, the torso portion having a left extension extending from the left side of said bodysuit and a right extension extending from the right side of said bodysuit, the extensions being located at a location between the leg covering portions and the top portion, one of the left or right extensions of the bodysuit having third fasteners located on the exterior of the extension and the other one of the left or right extensions having mating third fasteners on the interior of the extension, wherein the external and internal third fasteners on the left and right extensions of the bodysuit mate with each other forming a portion wrapping completely around a wearer's torso, said left and right sides of said bodysuit comprising a plurality of fourth fasteners extending from the top portion into the leg portions in a longitudinal line on the exterior surface of the rear section, and said shoulder strap portions comprising a plurality of fourth fasteners located on the exterior surface of the rear section;

a bodysuit front section having shoulder strap portions, a torso portion and partial leg covering portions, interior and exterior surfaces, and left and right sides extending from the partial leg covering portions upwards to a top portion, wherein the top portion is in a location corresponding to an underarm area of a wearer, said bodysuit front section interior surface comprising a plurality of complimentary fourth fasteners that mate with the fourth fasteners located on the exterior surface of the bodysuit rear section forming a complete bodysuit for covering a portion of a wearer's shoulders, the torso and a portion of the wearer's legs;

a bodysuit crotch section connecting said bodysuit front and rear sections together between the partial leg covering portions; and a shirt having a front panel, a rear panel, a left sleeve, and a right sleeve, the front panel having a top and bottom and an opening extending from the top to the bottom, the sleeves each having an end attached to the front and rear panels and a free end, the free ends comprising cuffs, the sleeves further having an opening extending from the cuff of the left sleeve, through the front panel and right sleeve to the cuff of the right sleeve, the openings being closable via a fastening mechanism.

8. The clothing combination of claim 7, wherein the bodysuit further includes torso straps extending from the rear section at a location substantially midway between the top portion and the leg covering portions and at a location corresponding to a conventional side seam location.

9. The clothing combination of claim 8, wherein said torso straps having complementary fastening materials.

10. The clothing combination of claim 7, wherein the bodysuit further comprises a plurality of guiding apparatuses on the bodysuit front section.

11. The clothing combination of claim 7, wherein said rear section of said bodysuit at the top portion of each of the left and right sides comprise left and right breast cups, wherein said left and right breast cups extend from the sides of the body suit towards the front center of the wearer, each breast cup having a fastening element on one end that mate with each other at the center of the wearer forming a complete breast encircling portion.

12. The clothing combination of claim 7, wherein the cuffs of said shirt having expandable means.

* * * * *